US007421221B2

(12) United States Patent
Suzuki

(10) Patent No.: US 7,421,221 B2
(45) Date of Patent: Sep. 2, 2008

(54) IMAGE FORMING DEVICE, POST-PROCESSING DEVICE AND COLOR CALIBRATION METHOD

(75) Inventor: Takayoshi Suzuki, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/723,310

(22) Filed: Mar. 19, 2007

(65) Prior Publication Data

US 2007/0189789 A1 Aug. 16, 2007

Related U.S. Application Data

(63) Continuation of application No. 10/935,197, filed on Sep. 8, 2004, now Pat. No. 7,206,068.

(30) Foreign Application Priority Data

Mar. 18, 2004 (JP) ..... 2004-077627

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS 5,875,372 A 2/1999 Sato et al.
6,178,007 B1 1/2001 Harrington
2003/0138261 A1* 7/2003 Tezuka et al. ..... 399/49
2004/0105691 A1 6/2004 Hama et al.
2005/0134874 A1 6/2005 Overall et al.

FOREIGN PATENT DOCUMENTS

KR 1020010100816 A 11/2001
KR 1020020055393 A 7/2002
KR 1020030042579 A 6/2003

* cited by examiner

*Primary Examiner*—David M Gray
*Assistant Examiner*—Bryan Ready
(74) *Attorney, Agent, or Firm*—Oliff & Berridge, PLC

(57) ABSTRACT

An image forming device includes: a toner image forming unit that forms a toner image onto a recording medium; a controlling unit that controls the toner image forming unit such that a test image is formed on the recording medium; a sheet transfer unit that transfers the recording medium having the toner image formed thereon by the toner image forming unit; a fixing unit that fixes the toner image formed by the toner image forming unit onto the recording medium; an image detecting unit, disposed downstream from the image fixing unit along the sheet transfer unit, that detects the test image formed on the recording medium; and a calibration unit that performs a color calibration process based upon the test image detected by the image detecting unit.

4 Claims, 16 Drawing Sheets

10 PRINTER DEVICE

10 PRINTER DEVICE

COLOR CALIBRATION PROCESS BEFORE PRINTING IS STARTED

S40

COLOR CALIBRATION PROCESS DURING PRINTING

S80

10 PRINTER DEVICE

COLOR CALIBRATION PROCESS DURING PRINTING

S82

COLOR CALIBRATION PROCESS DURING PRINTING

FIG. 13

| SENSOR | SHEET | SCREEN | TEST IMAGE | DIFFERENCE DATA | CALIBRATION VALUE |
|---|---|---|---|---|---|
| FIRST COLORIMETRIC SENSOR | SHEET 1 | SCREEN A | NO. 0012 | AAA − BBB | + aaa |
| | | | | BBB − CCC | + bbb |
| | | | | ... | ... |
| | SHEET 2 | SCREEN A | NO. 0014 | AAA − BBB | + fff |
| | | | | BBB − CCC | + ggg |
| | ⋮ | ⋮ | ⋮ | ⋮ | ⋮ |
| SECOND COLORIMETRIC SENSOR | SHEET 1 | SCREEN A | NO. 0012 | AAA − BBB | + aaa' |
| | | | | BBB − CCC | + bbb' |
| | | | | ... | ... |
| | SHEET 2 | SCREEN A | NO. 0014 | AAA − BBB | + fff' |
| | | | | BBB − CCC | + ggg' |
| | ⋮ | ⋮ | ⋮ | ⋮ | ⋮ |

COLOR CALIBRATION PROCESS DURING PRINTING

S86

COLOR CALIBRATION PROCESS DURING PRINTING

S88

IMAGE FORMING DEVICE, POST-PROCESSING DEVICE AND COLOR CALIBRATION METHOD

This is a Continuation of application Ser. No. 10/935,197 filed Sep. 22, 2004, which in turn claims the benefit of Japanese Application No. 2004-077627 filed Mar. 18, 2004. The entire disclosure of the prior application is hereby incorporated by reference herein in its entirety.

BACKGROUND OF THE INVENTION

1. Field of the Invention

The present invention relates to an image forming device performing a color calibration.

2. Description of the Related Arts

It is known to provide a method wherein color patches are printed at a regular interval during the use of a printer, whereby the color patches are detected by a sensor and a color calibration value is determined based upon the detected color.

SUMMARY OF THE INVENTION

The present invention is accomplished in view of the abovementioned circumstance, and provides an image forming device that can implement a satisfactory color calibration.

In order to address the problems stated above, an image forming device according to an aspect of the present invention has a toner image forming unit that forms a toner image onto a recording medium, controlling unit that controls the toner image forming unit such that a test image is formed on the recording medium, a sheet transfer unit that transfers the recording medium having the toner image formed thereon by the toner image forming unit, an image fixing unit that fixes the toner image formed by the toner image forming unit onto the recording medium, an image detecting unit, disposed downstream from the image fixing unit along the sheet transfer unit, that detects the test image formed onto the recording medium, and a calibration unit that performs a calibration process based upon the test image detected by the image detecting unit.

BRIEF DESCRIPTION OF THE DRAWINGS

Embodiments of the present invention will be described in detail based on the following figures, wherein:

FIGS. 3A and 3B are views illustrating a test image printed on both sides of a recording sheet, wherein FIG. 3A illustrates a test image printed on a front surface of a recording sheet 42 and FIG. 3B illustrates a test image printed on a back surface of the recording sheet 42;

FIGS. 4A to 4C are views illustrating a test image shifted in a slow-scanning direction, wherein FIG. 4A illustrates a test image printed on the front surface of the recording sheet 42, FIG. 4B illustrates a test image of the front surface that can be seen through the back surface and FIG. 4C illustrates a test image printed on the back surface;

FIG. 13 is a calibration table that is referred to by a calibration value deciding section 232 when it decides a calibration value (calibration data);

DETAILED DESCRIPTION OF THE INVENTION

A first embodiment of the present invention will be explained hereinbelow.

A printer device 10 to which the present invention is applied is explained.

Figure 1:
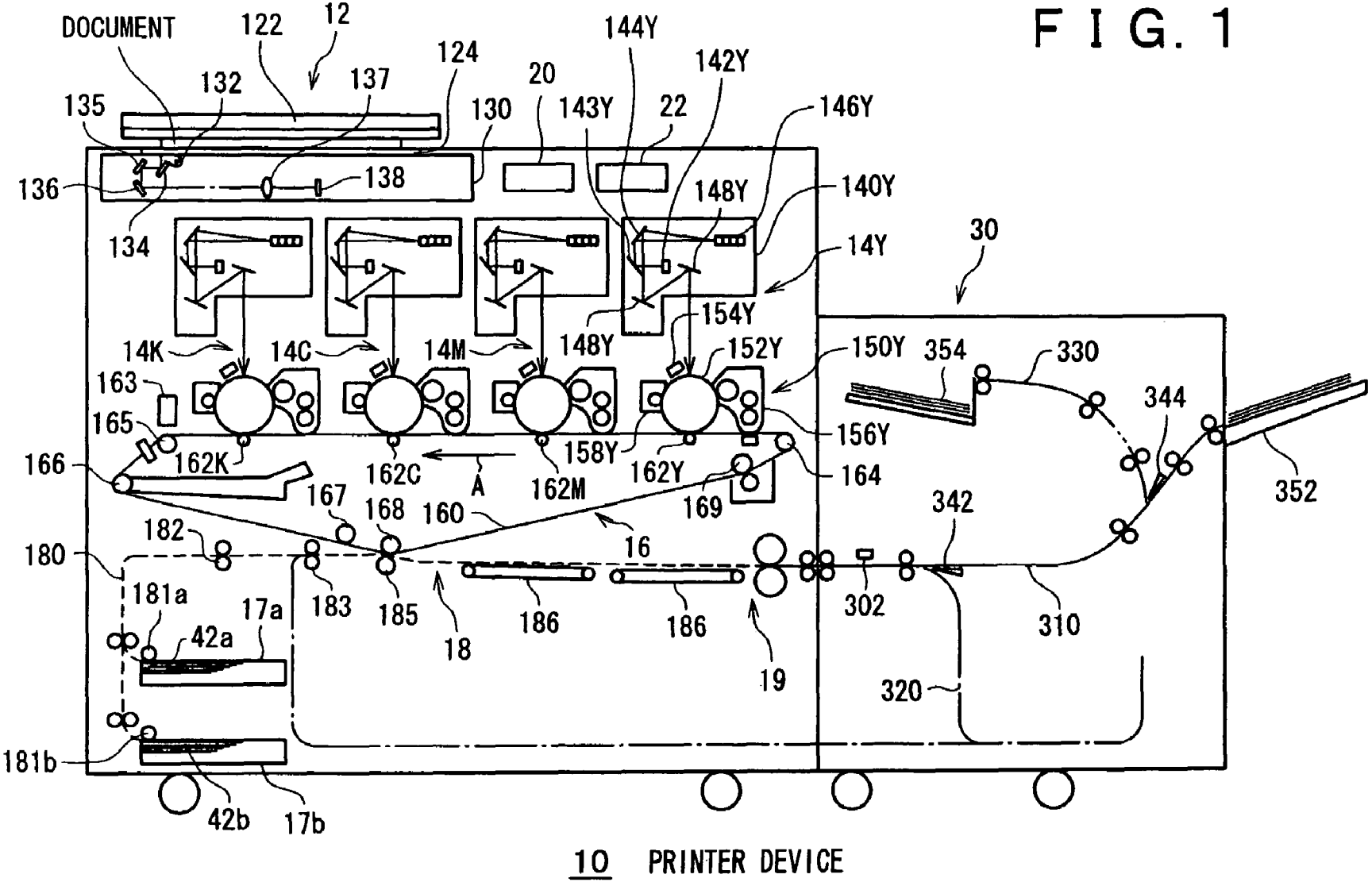
FIG. 1 is a view showing a construction of a tandem-type printer device (image forming device) 10.

FIG. 1 is a view showing a construction of the tandem-type printer device (image forming device) 10.

As shown in FIG. 1, the printer device 10 has an image reading unit 12, an image forming unit 14, an intermediate transfer device 16, a plural sheet feeding trays 17, a sheet transfer device 18, a fixing device 19, a controller 20, an image processing device 22 and a post-processing device 30. This printer device 10 may be a complex machine having a function as a full-color copier using the image reading unit 12 and a function as a facsimile in addition to a printer function for printing image data received from a personal computer (not shown). Although the tandem-type printer device 10 provided with plural photoreceptor drums 152 is taken as a specific example in this embodiment, the invention is not limited thereto. Usable printer devices include a rotary-type printer device provided with only a single photoreceptor drum 152, a printer device that forms a toner image of plural colors on a photoreceptor belt or drum, a printer device that directly transfers onto a recording medium a toner image on the photoreceptor or a printer device that performs a fixing process simultaneously with a transfer process.

Firstly, an outline of the printer device 10 will be explained. Mounted at the upper section of the printer device 10 are the image reading unit 12, controller 20 and image processing device 22. The image reading unit 12 reads an image on a document and outputs the same to the controller 20. The controller 20 sets an operation mode of each construction included in the printer device 10 based upon the image data inputted from the image reading device 12 or image data inputted from a personal computer (not shown) via a network such as LAN and set information of a user inputted via a user interface (not shown). The operation mode here is an operation type set in advance for each construction in the printer device 10. Further, the controller 20 outputs the inputted image data to the image processing device 22. The image processing device 22 performs image processing such as a tone correction and resolution correction to the inputted image data, and then, outputs the result to the image forming unit 14.

Mounted below the image reading unit 12 are plural image forming units 14 each corresponding to a color forming a color image. In this embodiment, a first image forming unit 14Y, a second image forming unit 14M, a third image forming unit 14C and a fourth image forming unit 14K, each corresponding to each color of yellow (Y), magenta (M), cyan (C) and black (K), are horizontally arranged along the intermediate transfer device 16 with a constant space. The intermediate transfer device 16 rotates an intermediate transfer belt 160 as an intermediate transfer member in a direction shown by an arrow A in the figure. These four image forming units 14Y, 14M, 14C and 14K successively form a toner image of each color based upon the image data inputted from the image processing device 22, and the formed images are transferred (primary transfer) on the intermediate transfer belt 160 at a timing when these plural toner images are superimposed with one another. It should be noted that the order of the color of each image forming unit 14Y, 14M, 14C and 14K is not limited to the order of yellow (Y), magenta (M), cyan (C) and black (K). The order of the color is optional, for example, the order of black (K), yellow (Y), magenta (M) and cyan (C). It should be noted that the toner image forming unit according to the present invention is, for example, a combination of the image forming unit 14 and the intermediate transfer device 16.

The sheet transfer device 18 is disposed below the intermediate transfer device 16. A recording sheet 42*a* or 42*b* fed from a first sheet feeding tray 17*a* or a second sheet feeding tray 17*b* is fed on this sheet transfer device 18, on which the toner image of each color that is transferred in a superimposed manner on the intermediate transfer belt 160 is transferred en bloc (secondary transfer). Then, the transferred toner image is fixed by the fixing device 19 and discharged to the outside through the post-processing device 30.

Subsequently, each construction of the printer device 10 will be explained in more detail.

As shown in FIG. 1, the image reading unit 12 has a platen glass 124 on which the document is placed, a platen cover 122 that presses the document to the platen glass 124 and an image reading device 130 that reads the image of the document placed on the platen glass 124. The image reading device 130 is constructed so as to irradiate the document placed on the platen glass 124 with a light source 132, to scan a reflected optical image from the document via a reduction optical system made up of a full-rate mirror 134, a first half-rate mirror 135, a second half-rate mirror 136 and a focusing lens 137 to expose the reflected optical image onto an image reading element 138 made up of a CCD or the like, whereby a color reflected optical image from the document is read by the image reading element 138 at a predetermined dot density (e.g., 16 dots/mm).

The controller 20 performs a predetermined image processing to the image data read by the image reading unit 12 such as shading correction, correction of positional displacement of the document, brightness/color space conversion, gamma correction and deletion of frame. It should be noted that the color reflected optical image of the document read by the image reading unit 12 is document reflectivity data of three colors of red (R), green (G) and blue (B) (each 8 bits) expressed by RGB color system, and it is converted into document color tone data (raster data) of four colors of yellow (Y), magenta (M), cyan (C) and black (K) by the color space conversion process by the controller 20. Further, the controller 20 controls the operation of the image forming unit 14, intermediate transfer device 16, sheet transfer device 18, image processing device 22 and post-processing device 30 in accordance with an instruction from a user.

The image processing device 22 performs image processing to the image data inputted from the controller 20 such as tone correction, density adjustment, sharpness correction and screen process, thereby obtaining binary image data suitable for the printing, and then, outputs the result to the image forming unit 14 corresponding to the image data (binary) of each color.

The first image forming unit 14Y, second image forming unit 14M, third image forming unit 14C and fourth image forming unit 14K are horizontally juxtaposed at a constant space. They have almost the same construction except that the color of the formed image is different. Therefore, the following explanation is made about the first image forming unit 14Y. It should be noted that the construction of each image forming unit 14 is distinguished by marking Y, M, C or K.

The image forming unit 14Y has an optical scanning device 140Y that scans a laser beam in accordance with the image data (binary) inputted from the image processing device 22 and an image forming device 150Y that forms an electrostatic latent image by the laser beam scanned by the optical scanning device 140Y.

The optical scanning device 140Y modulates semiconductor laser 142Y in accordance with the image data of yellow (Y) and emits laser beam LB (Y) from this semiconductor laser 142Y in accordance with the image data. The laser beam LB(Y) emitted from the semiconductor laser 142Y is applied to a rotational polygon mirror 146Y via the first reflection mirror 143Y and second reflection mirror 144Y, is deflected to be scanned by this rotational polygon mirror 146Y, and then, applied onto the photoreceptor drum 152Y of the image forming device 150Y via the second reflection mirror 144Y, third reflection mirror 148Y and fourth reflection mirror 149Y. It should be noted that the optical scanning device 140Y is provided with a light quantity balance correction device that adjusts a quantity of light of a laser beam in accordance with the instruction from the user interface device and the like and an automatic output control device for keeping the output of the laser beam constant, whereby the laser beam LB(Y) emitted from the semiconductor laser 142Y is adjusted to a desired output level.

The image forming device 150Y is made up of the photoreceptor drum 152Y that rotates at a predetermined rotational speed along the direction of arrow A as an image bearing member, a scorotron 154Y for a primary charge that uniformly charges the surface of this photoreceptor drum 152Y as a charging unit, a developing device 156Y that develops the electrostatic latent image formed on the photoreceptor drum 154Y and a cleaning device 158Y. The photoreceptor drum 152Y is uniformly charged with the scorotron 154Y, whereby the electrostatic latent image is formed by the laser beam LB(Y) applied from the optical scanning device 140Y. The electrostatic latent image formed onto the photoreceptor drum 152Y is developed with yellow (Y) toner by the developing device 156Y and transferred onto the intermediate transfer device 16. It should be noted that residual toner or sheet particles adhered to the photoreceptor drum 152Y after the transferring process of the toner image are removed by the cleaning device 158Y. Moreover, a potential sensor (not shown) for measuring the charged amount on the surface of the photoreceptor drum 152Y is provided in the vicinity of the photoreceptor drum 152Y, whereby charge bias voltage applied to the scorotron 154Y is controlled according to the output from this potential sensor.

Like the abovementioned manner, the other image forming units 14M, 14C and 14K form a toner image of each color of magenta (M), cyan (C) and black (K) and transfers the formed toner image of each color onto the intermediate transfer device 16.

The intermediate transfer device 16 has an intermediate transfer belt 160 (image bearing member) looped with a constant tension around a drive roller 164, a first idle roller 165, a steering roller 166, a second idle roller 167, a back-up roller 168 and a third idle roller 169. The drive roller 164 is rotatably driven by a driving motor (not shown), whereby the intermediate transfer belt 160 is circularly driven in the direction of arrow A at a predetermined speed. The intermediate transfer belt 160 is formed into an endless belt by, for example, forming a synthetic resin film such as polyimide having flexibility into a band, both ends of which are joined with adhesion.

Further, the intermediate transfer device 16 has a first primary transfer roller 162Y, a second primary transfer roller 162M, a third primary transfer roller 162C and a fourth primary transfer roller 162K at each position corresponding to each image forming unit 14Y, 14M, 14C and 14K, whereby it transfers the toner image of each color formed on each of the photoreceptor drums 152Y, 152M, 152C and 152K in a superimposed manner onto the intermediate transfer belt 160 by these primary transfer rollers 162. Residual toner adhered onto the intermediate transfer belt 160 is removed by a cleaning blade or brush of a cleaning device for the belt disposed at the downstream side of the secondary transfer position.

Moreover, a density sensor 163 is provided in the vicinity of the intermediate transfer belt 160. The density sensor 163 optically reads the toner image transferred onto the surface of the intermediate transfer belt 160. The toner image read by the density sensor 163 is used for detecting non-uniform density and positional displacement of the toner image of each color.

The sheet transfer device 18 has an image forming path 180 (broken line section in the figure) from the sheet feeding tray 17 to the fixing device 19, a sheet discharge path 310 (solid line section in the figure) from the fixing device 19 to a sheet exit tray 352, a sheet reversing path 320 (one-dot-chain line section in the figure) that is branched at a first branch position from the sheet discharge path 310 for reversing the recording sheet 42, a purge path 330 (two-dot-chain line section in the figure) that is branched at a second branch position from the sheet discharge path 310 for discharging a recording sheet to a purge tray 354 and transfer rollers for transferring the recording sheet 42 onto these paths. The first branch position is a position where a first changeover plate 342 is disposed in FIG. 1 and the second branch position is a position where a second changeover plate 344 is disposed in FIG. 1.

Disposed at the image forming path 180 are first sheet feed roller 181*a* and second sheet feed roller 181*b* for picking up the first recording sheet 42*a* or second recording sheet 42*b* from the first sheet feeding tray 17*a* or second sheet feeding tray 17*b*, a pair of rollers 182 for transferring the sheet and a resist roller 183 for transferring the recording sheet 42*a* or 42*b* to the secondary transfer position at a fixed timing.

Moreover, a secondary transfer roller 185 that is in pressed contact with a back-up roller 168 is disposed at the secondary transfer position on the image forming path 180. The toner image of each color transferred onto the intermediate transfer belt 160 in a superimposed manner is secondary transferred onto the recording sheet 42*a* or 42*b* with press-contact force and electrostatic force by the secondary transfer roller 185. The recording sheet 42*a* or 42*b* having the toner image of each color transferred thereon is fed to the fixing device 19 by two transfer belts 186.

The fixing device 19 applies a heating process and pressurizing process to the recording sheet 42*a* or 42*b* having the toner images of each color transferred thereon, so that the toner is fused and fixed onto the recording sheet 42*a* or 42*b*.

The sheet discharge path 310 is disposed next to the fixing device 19. The recording sheet 42*a* or 42*b* to which the fixing process (heating and pressurizing) is applied passes through the sheet discharge path 310 and is discharged to the outside of the printer device 10 and stacked onto the exit tray 352.

The post-processing device 30 is detachably mounted to the printer device body. It performs a post-processing according to the control by the controller 20 such as a sorting, stapling and paper-folding (not shown). The post-processing device 30 has the exit tray 352 for stacking the recording sheet 42 supplied to the user and the purge tray 354 for stacking the recording sheet 42 that should be disposed. Further, provided at the post-processing device 30 are a part of the sheet discharge path 310, a part of the sheet reversing path 320 and the purge path 330.

If the one-sided printing and the sheet output wherein the printing surface faces upward (hereinafter referred to as face-up output) is designated, the recording sheet 42 having the fixing process applied thereto is fed through the sheet discharge path 310 and discharged onto the exit tray 352 as it is.

Further, if the one-sided printing and the sheet output wherein the printing surface faces downward (hereinafter referred to as face-down output) is designated, the recording sheet 42 having the fixing process applied thereto is fed to the sheet reversing path 320 by the first changeover plate 342 at the first branch position to be reversed, and then, discharged to the exit tray 352.

Moreover, if the duplex printing is designated, the recording sheet 42 having the first surface on which the toner image is fixed is fed to the sheet reversing path 320 by the first changeover plate 342 to be reversed, and then, fed again to the secondary transfer position. When the toner image is transferred onto the second surface at the secondary transfer position, this recording sheet 42 is subject to the fixing process, and then, passes through the sheet discharge path 310 to be discharged onto the exit tray 352.

Further, if the disposal of the recording sheet 42 is designated, the recording sheet 42 fed through the sheet discharge path 310 is fed to the purge path 330 by the second changeover plate 344 at the second branch position, and then, discharged onto the purge tray 354.

Further, a colorimetric sensor 302 is mounted to the sheet discharge path 310. The colorimetric sensor 302 in this embodiment is mounted on the sheet discharge path 310 at the downstream side from the fixing device 19 and at the upstream side from the first branch position. The colorimetric sensor 302 reads the image on the recording sheet 42*a* or 42*b*, that is being fed on the sheet discharge path 310, for measuring characteristic amount of this image. The characteristic amount measured by the colorimetric sensor 302 includes, for example, color data (density of each color, saturation, color phase, color distribution or the like).

Subsequently explained is a background of the present invention and an outline of this embodiment.

In the printer device 10, the density or tone reproducibility of the printed image is changed due to an environmental change or the fluctuation of the device characteristic. If plural images are successively printed, in particular, an image quality becomes different among plural images printed in accordance with the same print command due to the environmental change during the printing or the fluctuation of the device characteristic, resulting in noticeable color development fluctuation.

In view of this, it is desirable that a color calibration process is performed at a fixed interval based upon a test image printed by the printer device 10. Here, the color calibration process means a process for adjusting the printer device based upon the test image printed on the recording sheet. This color calibration process includes a test image printing process for printing the test image, a difference detecting process for detecting a difference between the basic device characteristic (color development characteristic) and the current device characteristic (color development characteristic), and a process for adjusting the device characteristic based upon the result of the difference detecting process.

The printer device in this embodiment particularly prints the test image onto the recording sheet 42 for performing the color calibration process based upon this test image when images are successively printed. Specifically, the printer device 10 in this embodiment allows the color calibration process to interrupt during the printing process required from the user, thereby reducing the color development fluctuation during the successive printing.

It is considered that the calibration process is performed based upon the toner image onto the photoreceptor drum 152 or the intermediate transfer belt 160. However, the toner image formed on the photoreceptor 152 is a single color, so it is difficult to estimate the color development of the case where toners of plural colors are superimposed (i.e., the color development of the mixed color), based upon this toner image. Further, when the toner image is fused and fixed onto the recording sheet 42, the color development occurs due to the mutual relation of the characteristic on the surface of the recording sheet 42, the order of the superimposition of the toner images of plural colors and properties of these toners, so it is difficult to perform the satisfactory color calibration based upon the toner image formed on the intermediate transfer belt 160. Therefore, the printer device 10 of this embodiment desirably performs the color calibration process based upon the toner image formed on the recording sheet 42. More preferably, the printer device 10 performs the color calibration process based upon the toner image that is subject to the fixing process. In the printer device 10 in this embodiment, the test image is read from the recording sheet 42 now being fed by the colorimetric sensor 302 mounted at the following stage from the fixing device 19, whereby the color calibration process is performed based upon the read test image.

Figure 2:
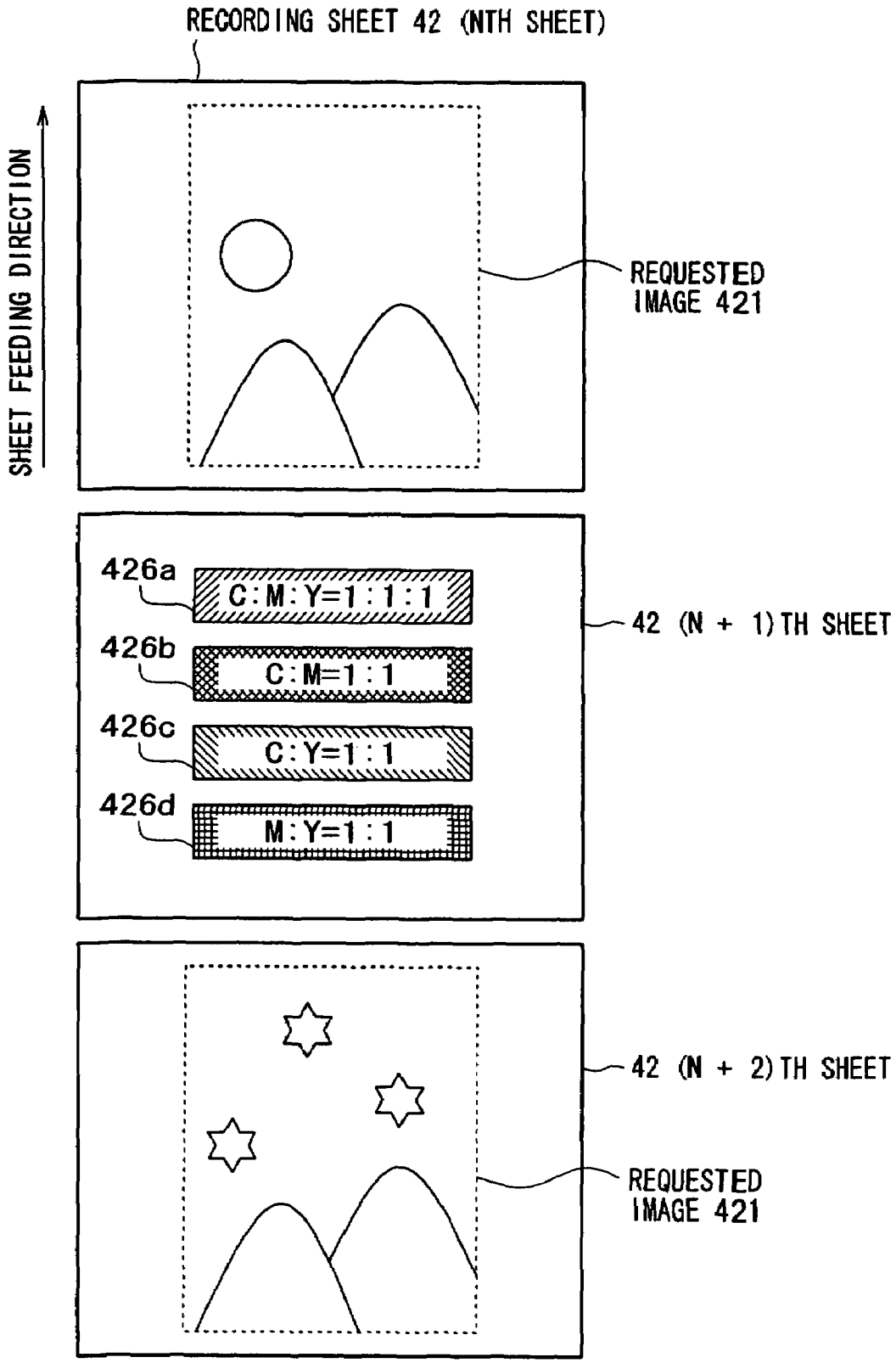
FIG. 2 is a view illustrating a test image printed by the printer device 10.

FIG. 2 is a view illustrating the test image printed by the printer device 10.

If plural images (hereinafter referred to as a requested image) requested to be printed by a user are successively printed, the printer device 10 in this embodiment allows the printing process of the test image to interrupt the successive printing process, so the requested image and the color calibration pattern 426 (i.e., test image) are printed alternatively onto a different recording sheet 42, as illustrated in FIG. 2. The test image printed on the recording sheet 42 includes plural calibration patterns 426*a* to 426*d*. These calibration patterns 426*a* to 426*d* are printed in a range that can be read by the colorimetric sensor 302 (FIG. 1) (for example, in the vicinity of the center of the recording sheet 42). In this figure, the first calibration pattern 426*a* is an image of mixed color (tertiary color) of toners of three colors. Specifically, toners of three colors are mixed so as to provide the image having an almost achromatic color. Further, each of the second calibration pattern 426*b*, third calibration pattern 426*c* and fourth calibration pattern 426*d* is an image of mixed color (secondary color) of toners of two colors.

It is desirable that the mixed color included in the calibration pattern 426 is selected from the mixed color of an almost achromatic color having high visibility in the color development fluctuation and including all color materials or selected according to a color used in the following printing process (in this embodiment, the printing process after (N+2)th sheet). For example, the printer device 10 in this embodiment selects, from mixed colors used for the following printing process, an almost achromatic color having high frequency of occurrence, wherein only the calibration pattern 426 of the selected color is printed on the recording sheet 42 as the test image. In this way the printer device 10 can restrain the number of the calibration patterns 426 printed on the recording sheet 42, thereby being capable of preventing the productivity from being reduced. Moreover, the printer device 10 prints the selected calibration pattern 426 as large as possible in the limited printing area on the recording sheet 42, thereby being capable of enhancing the reading precision of the calibration pattern 426 by the colorimetric sensor 302.

Figure 3A:
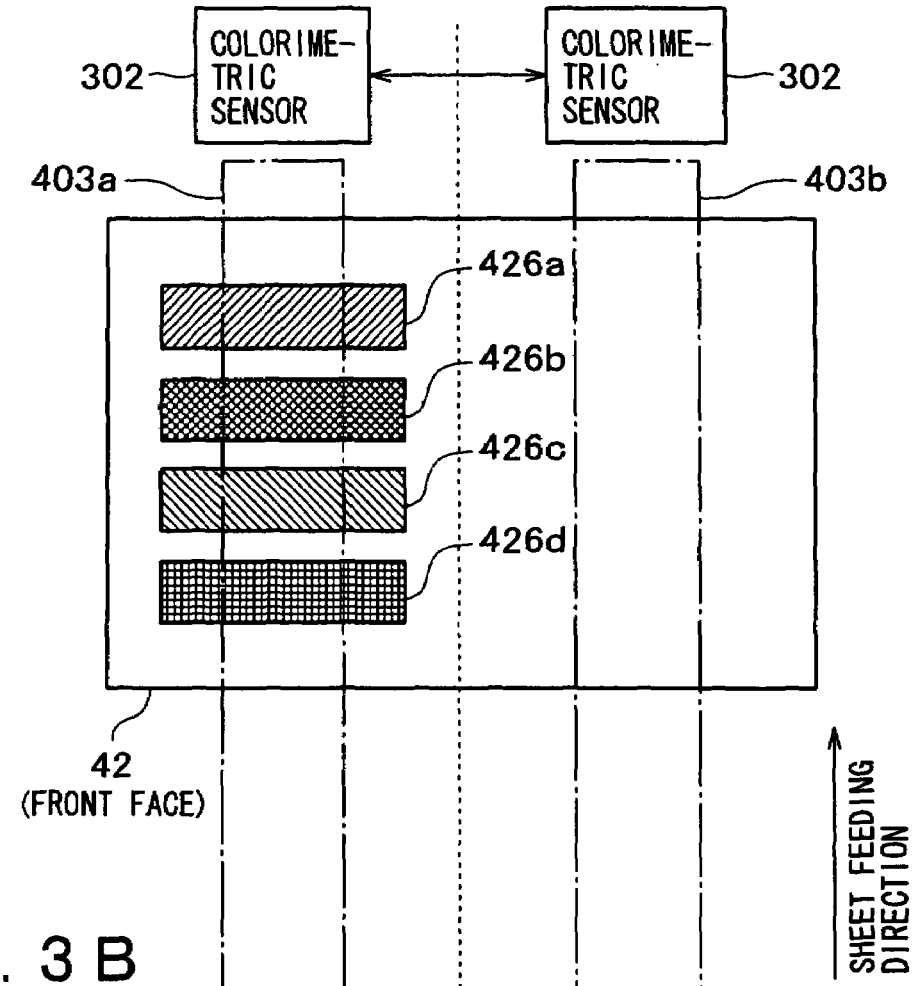
Figure 3B:
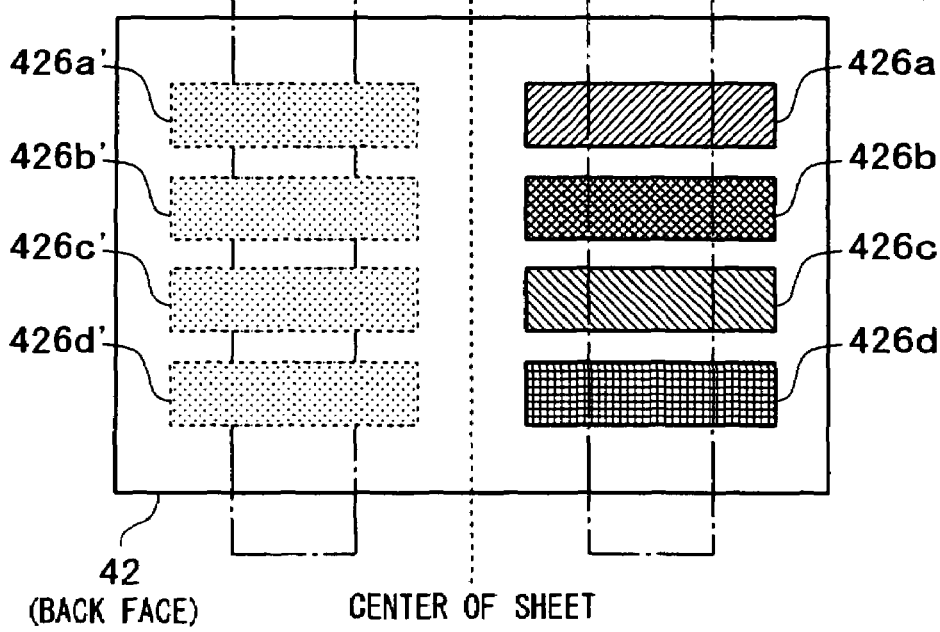

FIG. 3 is a view illustrating the test image printed on both sides, wherein FIG. 3A illustrates a test image printed on the front surface of the recording sheet 42 and FIG. 3B illustrates a test image printed on the back surface of the recording sheet 42.

As illustrated in FIG. 3, the printer device 10 prints the test patterns 426*a* to 426*d* printed on the front surface and the test patterns 426*a* to 426*d* printed on the back surface so as to be shifted to each other in the direction perpendicular to the sheet transferring direction (i.e., the fast-scanning direction of the image forming unit 14) such that the test images printed on the front surface (first surface) of the recording sheet 42 and the test images printed on the back surface (second surface) are not overlapped with each other. Specifically, the printer device 10 prints the test patterns such that the test patterns 426*a* to 426*d* printed on one surface of the recording sheet 42 can be seen through the other surface as the test patterns 426*a*' to 426*d*' to thereby prevent that they overlap with the test patterns 426*a* to 426*d* printed on the other surface. This prevents the fluctuation in the color balance of the test pattern 426 that is caused by overlapping the see-through test patterns 426*a*' to 426*d*' with the test patterns 426*a* to 426*d*. Although the test pattern 426 printed on the second surface is the same as the test pattern 426 printed on the first surface in order to enhance the reading precision by the colorimetric sensor 302 in this embodiment, they may be different from each other. This makes it possible to print the test image formed of various mixed colors in the limited printing area.

The recording sheet 42 in this embodiment reverses at an axis perpendicular to the sheet transferring direction for passing through the sheet reversing path 320 shown in FIG. 1. Therefore, the printer device 10 in this embodiment shifts the position where the test pattern 426 is printed on the first surface (front surface) of the recording sheet 42 and the position where the test pattern 426 is printed on the second surface (back surface) in the fast-scanning direction.

If the recording sheet 42 is reversed with the sheet transferring direction defined as an axis, the printer device 10 prints the test pattern 426 at the same position that is shifted from the central position of the recording sheet 42 in the fast-scanning direction on both the first surface and the second surface. This is because the test pattern 426 printed on the first surface moves symmetrically with respect to the center line of the sheet transferring direction in the recording sheet since the recording sheet 42 is reversed.

The printer device 10 is required to change the reading position of the test pattern 426 between the case where the test image printed on the first surface is read by the calorimetric sensor 302 (FIG. 3A) and the case where the test image printed on the second surface is read by the colorimetric sensor 302 (FIG. 3B). Specifically, the printer device 10 in this embodiment moves the calorimetric sensor 302 in the fast-scanning direction (the direction perpendicular to the sheet transferring direction) during the period from when the test image on the first surface is read to when the test image on the second surface is read. According to this, the printer device 10 can provide a first readable range 403*a* by the calorimetric sensor 302 if the test image on the first surface is read and a second readable range 403*b* if the test image on the second surface is read.

If a calorimetric sensor 302 that is long in the fast-scanning direction is applied (i.e., if the readable range 430 by the colorimetric sensor 302 can read the test patterns 426 on both the first surface and the second surface), a color calibration section 230 (described later) extracts to apply the characteristic amount of the test image from each of the first readable range 403*a* and the second readable range 403*b*.

Figures 4A, 4B, 4C:
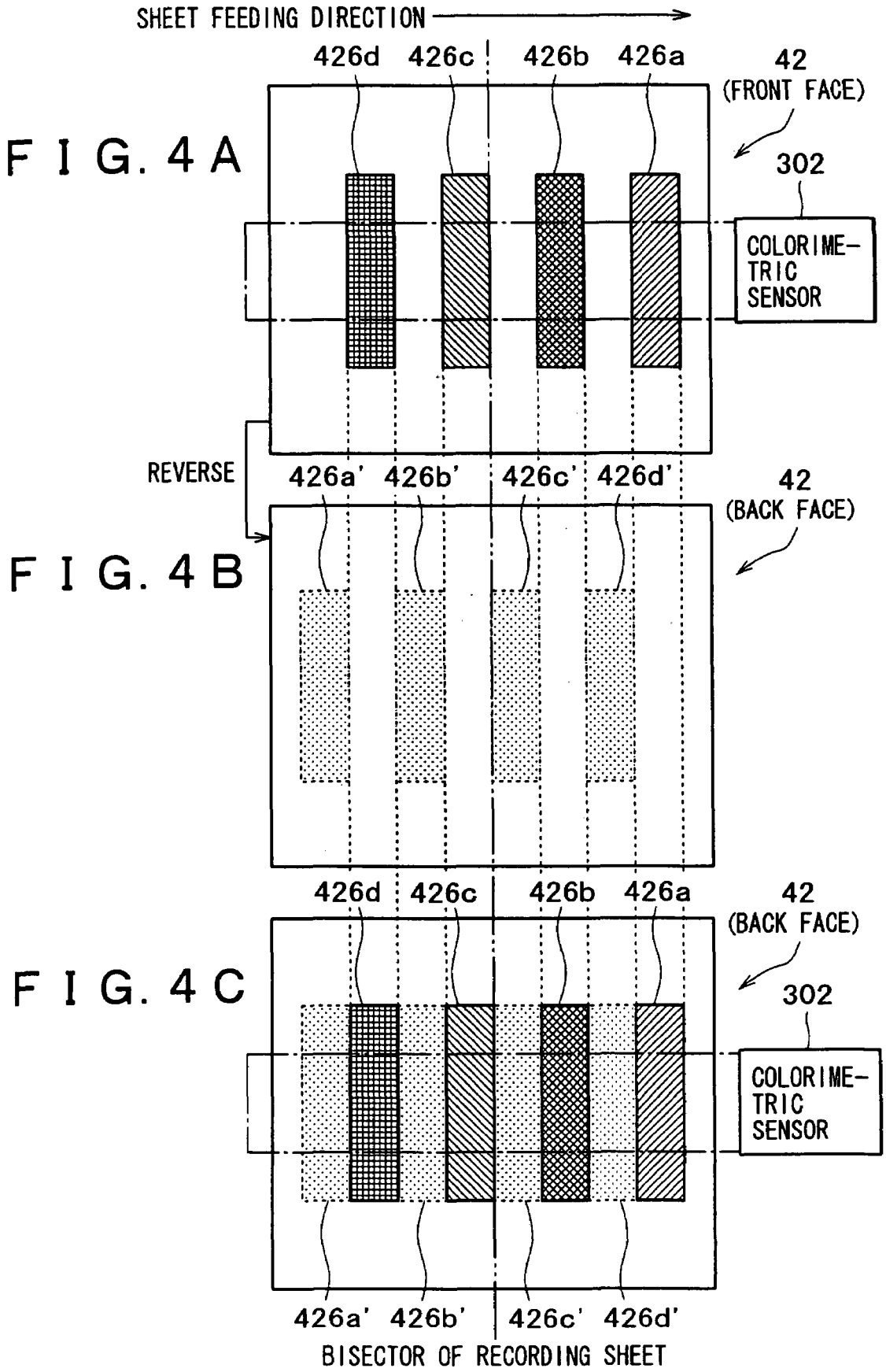

FIG. 4 is a view illustrating a test image shifted in the slow-scanning direction, wherein FIG. 4A illustrates a test image printed on the front surface of the recording sheet 42, FIG. 4B illustrates a test image on the front surface that can be seen through the back surface and FIG. 4C illustrates a test image printed on the back surface.

As illustrated in FIG. 4A, the printer device 10 prints the test patterns 426*a* to 426*d* at each fixed position on the first surface (front surface) of the recording sheet 42, and then, reverses this recording sheet 42 by the sheet reversing path 320 (FIG. 1). When the recording sheet 42 rotates about the fast-scanning direction at an angle of 180 degrees, the test patterns 426*a* to 426*d* printed on the front surface of the recording sheet 42 moves symmetric with respect to the line that bisects the recording sheet 42 in the slow-scanning direction and can be seen through the back surface (can be seen as the test patterns 426*a*' to 426*d*' in the figure) as illustrated in FIG. 4B.

The printer device 10 in this embodiment prints the test patterns 426*a* to 426*d* on the back surface so as not to be overlapped with the test patterns 426*a*' to 426*d*' that can be seen through the back surface from the front surface as illustrated in FIG. 4C.

Since the printer device 10 in this embodiment determines the printing position on the first surface and the shape of the test pattern in order that the test patterns 426 may not be overlapped with each other after or before the reverse of the recording sheet 42, the test pattern 426 on the first surface and the test pattern 426 on the second surface do not overlap with each other even if the test patterns 426 having the same shape are printed at the same position on the first and second surfaces.

It should be noted that the printer device 10 can read both the test image on the first surface and the test image on the second surface without moving the colorimetric sensor 302 in this embodiment.

Figure 5:
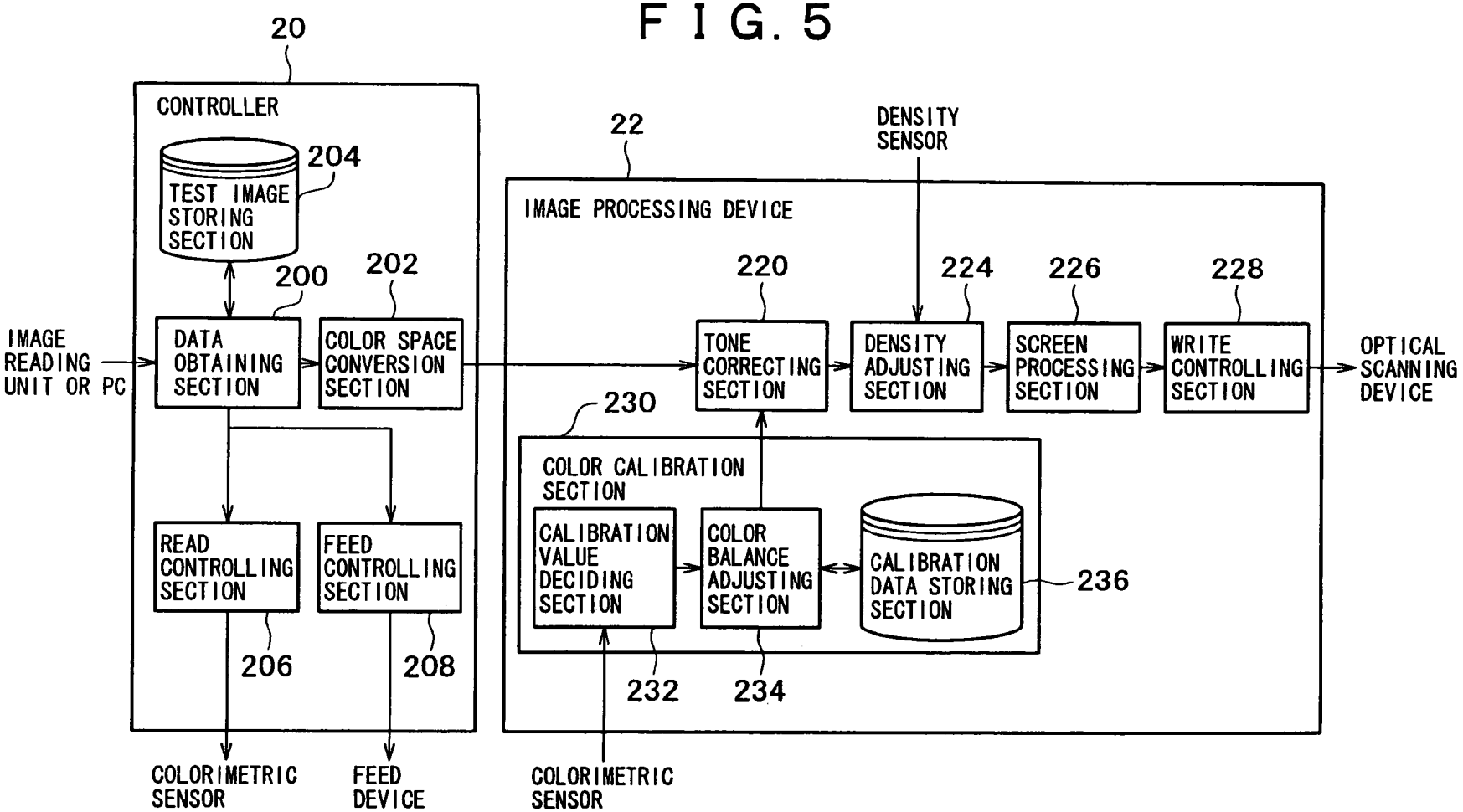
FIG. 5 is a view illustrating a functional construction of a controller 20 and an image forming device 22.

FIG. 5 is a view illustrating the functional construction of the controller 20 and the image processing device 22.

As illustrated in FIG. 5, the controller 20 has a data obtaining section 200 (controlling unit), a color space conversion section 202, a test image storing section 204, a read controlling section 206 and a sheet transfer controlling section 208. Further, the image processing device 22 has a tone correcting section 220, a density adjusting section 224, a screen processing section 226, a write controlling section 228 and a color calibration section 230 (calibration unit), wherein the color calibration section 230 includes a calibration value deciding section 232, a color balance adjusting section 234 and a calibration data storing section 236.

It should be noted that each of the abovementioned constructions included in the controller 20 and the image processing device 22 may be implemented from a software point of view by a CPU and the like, memory and program or from a hardware point of view by an ASIC and the like.

In the controller 20, the data obtaining section 200 obtains print command data including image data from the image reading unit 12 (FIG. 1) or a personal computer of the user and generates at least one job based upon the obtained image data. The job means a process unit in the image processing device 22, image forming unit 14, intermediate transfer device 16, sheet feeding tray 17, sheet transfer device 18, fixing device 19 and post-processing device 30, including, for example, a normal job wherein only the requested image is printed and a calibration job wherein the test image is printed. These jobs include information for specifying the image data that should be printed and the operation mode (hereinafter referred to as mode specifying information). This mode specifying information includes information of the number to be printed, a type of the recording sheet used for the printing, color/monochrome, a type of the screen, output method of the recording sheet (discharging method) and output resolution. When generating a job, the data obtaining section 200 outputs the generated job to the color space conversion section 202.

Further, if the data obtaining section 200 sends a job to the image processing device 22, the data obtaining section 200 decides the operation mode in accordance with this job (mode specifying information), and outputs the operation mode information to the read controlling section 206 and the sheet transfer controlling section 208 so as to make the image forming unit 14, intermediate transfer device 16, sheet feeding tray 17, sheet transfer device 18, fixing device 19 and the post-processing device 30 operate in the decided operation mode.

The color space conversion section 202 converts the image data (RGB) included in the job into image data (YMCK) of a color system suitable for the printing process and outputs the result to the image processing device 22. Specifically, the color space conversion section 202 memorizes in advance a color conversion table for performing the color conversion. It refers to the color conversion table to convert a pixel value of each pixel.

The test image storing section 204 memorizes in advance image data of plural test patterns 426 (FIG. 2). It outputs the image data of the test pattern 426 to the data obtaining section 200 in accordance with the request from the data obtaining section 200. The test patterns 426 memorized in the test image storing section 204 include at least a mixed color (secondary color or tertiary color) that is desirably almost achromatic. The mixed color is obtained by mixing plural colors so as to be visually recognized as one color. For example, dots of plural colors are interspersed in the vicinity area to form a mixed color that is recognized as one color by a human being's sight.

The image data of the test pattern 426 inputted to the data obtaining section 200 is attached to the calibration job, and then, inputted to the image processing device 22 via the color space conversion section 202.

The read controlling section 206 controls the operation of the calorimetric sensor 302 based upon the operation mode inputted from the data obtaining section 200. For example, if the duplex printing is designated as the operation mode, the read controlling section 206 moves the colorimetric sensor 302 so as to be able to respectively read the test images (FIG. 3) printed on both sides of the recording sheet 42. Further, the read controlling section 206 decides the reading timing (including the inhibition of the reading) by the calorimetric sensor 302, thereby controlling the operation timing of the colorimetric sensor 302.

The sheet transfer controlling section 208 controls the operation of the sheet transfer device 18 based upon the operation mode inputted from the data obtaining section 200. If the duplex printing is designated as the operation mode, for example, the sheet transfer controlling section 208 operates the first changeover plate 342 to transfer the recording sheet 42, having the image printed on the first surface, to the sheet reversing path 320 and then to transfer again this recording sheet 42 to the secondary transfer position. Moreover, if the face-down output is designated as the operation mode, the sheet transfer controlling section 208 moves the first changeover plate 342 to transfer the recording sheet 42, having the image printed on the front surface, to the sheet reversing path 320 and then to discharge this recording sheet 42 to the exit tray 352 with the back surface facing upward. Further, if the printing process for the recording sheet 42 that should be disposed is designated (for example, if the calibration job is inserted), the sheet transfer controlling section 208 moves the second changeover plate 342 to transfer the recording sheet 42 to the purge path 330 and discharge the same to the purge tray 354.

In the image processing device 22, the tone correcting section 220 corrects the inputted image data (the image data included in the job) to the tone suitable for the printing process and outputs the result to the density adjusting section 224. Specifically, the tone correcting section 220 memorizes in advance a tone correction table for correcting the tone and converts a pixel value of each pixel by referring to this tone correction table.

The density adjusting section 224 detects non-uniform density based upon the density of the toner image inputted from the density sensor 163 (FIG. 1), converts a pixel value of each pixel so as to eliminate the detected non-uniform density and outputs the result to the screen processing section 226.

The screen processing section 226 performs a screen process to the image data (multi-value data) inputted from the density adjusting section 224 to convert it into binary image data, and then, outputs the converted data to the write controlling section 228. Specifically, the screen processing section 226 memorizes in advance plural screens having different mesh shape, cycle or angle. It adopts a screen according to the inputted image data to convert the multi-value image data into binary image data.

The write controlling section 228 generates a pulse signal in accordance with the inputted image data (binary) from the screen processing section 226 and outputs this pulse signal to the optical scanning device 140.

The color calibration section 230 adjusts the color development property of the image printed by the printer device 10 based upon the characteristic amount of the test image inputted from the colorimetric sensor 302. Specifically, the color calibration section 230 includes the calibration value deciding section 232, color balance adjusting section 234 and calibration data storing section 236. The calibration value deciding section 232 controls the colorimetric sensor 302 (FIG. 1) to measure the characteristic amount of the test pattern 426 (FIG. 2) printed on the recording sheet 42. The measured characteristic amount is, for example, a density of a color corresponding to the respective calibration patterns.

The calibration value deciding section 232 compares the measured characteristic amount with a reference value (fixed value corresponding to the type of the test image) that is a target value of the color calibration process, to thereby generate calibration data that specifies the color calibration amount according to the difference value between this characteristic amount and the reference value, whereupon it outputs this calibration data to the color balance adjusting section 234.

The color balance adjusting section 234 renews the tone correction table memorized in the tone correcting section 220 based upon the calibration data inputted from the calibration value deciding section 232 in order to adjust the color balance. Specifically, the color balance adjusting section 234 temporarily stores the calibration data inputted from the calibration value deciding section 232 to the calibration data storing section 236 and reads the calibration data from the data storing section 236 at a fixed timing, thereby changing a correction coefficient of the tone correction table memorized in the tone correcting section 220 according to the read calibration data. The tone correcting section 220 performs tone correction by referring to the tone correction table renewed by the color balance adjusting section 234, thereby being capable of outputting the image data having the color balance adjusted.

The color balance adjusting section 234 may adjust the color balance of the output image by changing the coefficient of the color conversion table referred to by the color space conversion section 202, the coefficient of the screen (for example, dither matrix) applied by the screen processing section 226 or quantity of light emitted from the optical scanning device 140, based upon the calibration data inputted from the calibration value deciding section 232.

Figure 6:
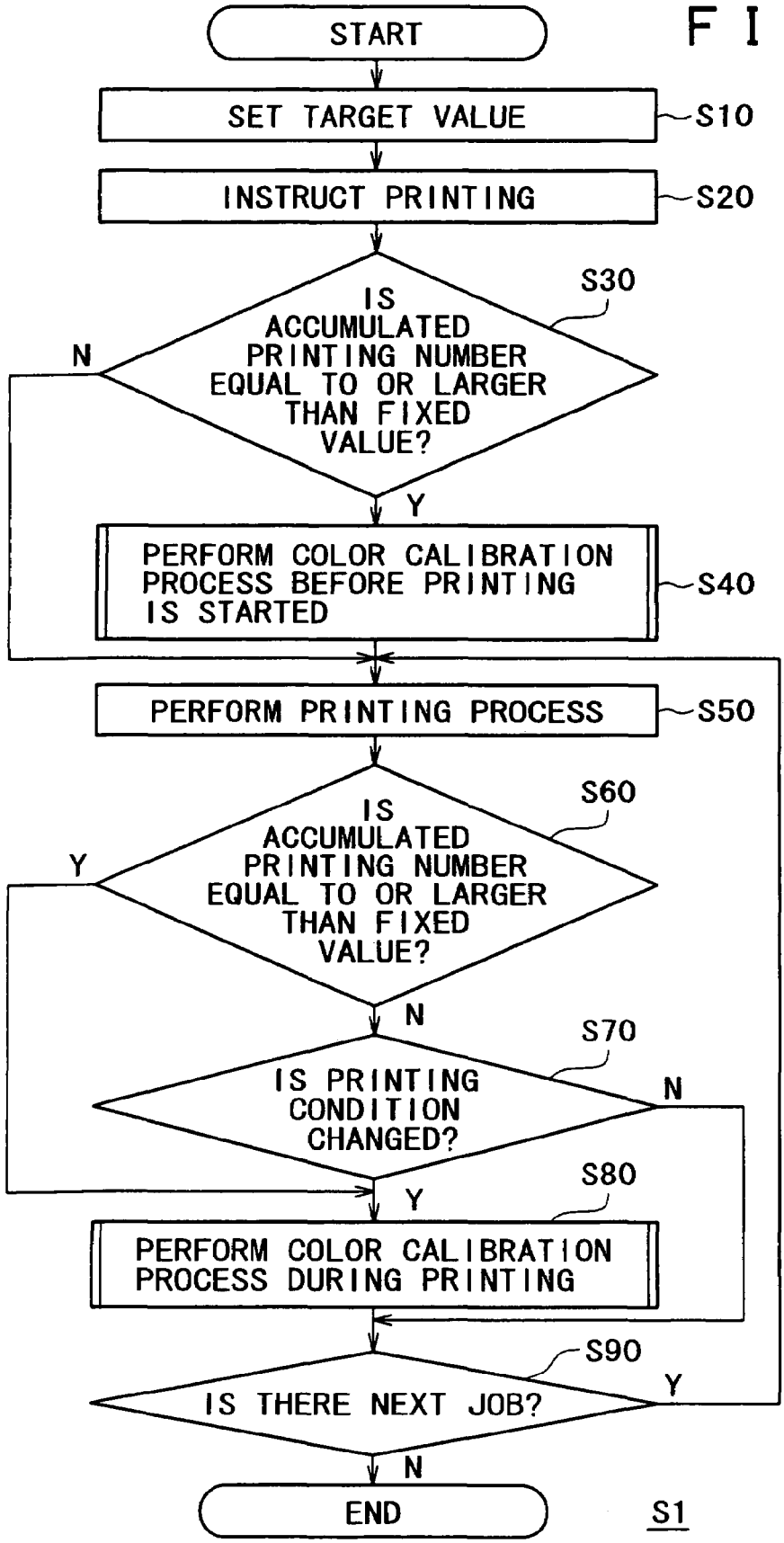
FIG. 6 is a flowchart for explaining the operation (S1) of the printer device 10.

FIG. 6 is a flowchart for explaining the operation (S1) of the printer device 10.

As shown in FIG. 6, the calibration value deciding section 232 (FIG. 5) sets the reference value that is a target value for the color calibration process at a step 10 (S10). The set reference value is, for example, a characteristic amount of the test image if the color calibration process is manually performed.

At a step 20 (S20), a user gives a print command via a personal computer or a user interface device of the printer device 10. When the print command data (including information for designating a number to be printed, a type of the recording sheet, duplex printing/one-sided printing, face-up output/face-down output and color/monochrome) is inputted, the data obtaining section 200 obtains image data of the requested image according to this print command data via a network or the image reading unit 12 and memorizes the obtained image data and the print command data so as to establish one-to-one correspondence.

The controller 20 determines whether or not the accumulated printing number is equal to or larger than a fixed value at a step 30 (S30). If the accumulated printing number is equal to or larger than the fixed value, the program moves to a process at S40. If the accumulated printing number is less than the fixed value, the program moves to a process at S50. Specifically, if the accumulated printing number reaches the fixed value, the printer device 10 performs the color calibration process before the printing to eliminate the fluctuation in the color development property.

Before executing the printing process requested by the user, the printer device 10 prints the test image and performs the color calibration process based upon the printed test image at the step 40 (S40).

At the step 50 (S50), the data obtaining section 200 divides the image data, that should be printed, based upon the printing number to generate plural jobs (normal jobs), and then, outputs the generated normal jobs to the color space conversion section 202.

The color space conversion section 202 converts the image data (RGB) included in the normal jobs into the image data (YMCK) for the printing and outputs the result to the tone correcting section 220. The tone correcting section 220 refers to the tone correction table to perform the tone correcting process to the inputted image data and outputs the result to the density adjusting section 224. The density adjusting section 224 performs a density adjusting process for the inputted image data so as to correct the density change of the toner image of a single color based upon the toner image density inputted from the density sensor 163 (FIG. 1) and outputs the result to the screen processing section 226. The screen processing section 226 performs a screen process to the image data (multi-value data) inputted from the density adjusting section 224 to binarize it, and then, outputs the binarized data to the write controlling section 228. The write controlling section 228 generates a pulse signal according to the inputted image data (binary data). Further, it outputs to the optical scanning device 140 (FIG. 1) a correction signal for eliminating the non-uniform density in the fast-scanning direction and slow-scanning direction based upon the correction signal visually measured or measured by the density sensor to be set to the image processing device 22. The electrostatic latent image written onto the photoreceptor drum 152 is developed by a toner of each color by the developing device 156. The developed toner image of each color is transferred onto the intermediate transfer device 16 in a superimposed manner. The toner image transferred in a superimposed manner by the intermediate transfer device 16 is transferred onto the recording sheet 42 fed from the sheet feeding tray 17 at the secondary transfer position. The recording sheet 42 having the toner image (requested image) transferred thereon is fed to the fixing device 19 to be subject to the fixing process, and then, fed to the outside of the device through the sheet discharge path 310.

At a step 60 (S60), the controller 20 counts up the accumulated printing number every time the requested image is printed, and determines whether or not the accumulated printing number is equal to or larger than the fixed value. If the accumulated printing number is equal to or larger than the fixed value, the controller 20 moves to a process at S80. If the accumulated printing number is less than the fixed value, the controller moves to a process at S70. Specifically, the printer device 10 forcibly inserts the calibration job to allow the color calibration process to interrupt, if the accumulated printing number reaches the fixed value.

At the step 70 (S70), the controller 20 determines whether or not the printing condition in the successive printing process (for example, the type of the recording sheet 42 used for the printing or the type of the screen applied by the screen processing section 226) is changed. If the type of the recording sheet 42 or the type of the screen applied by the screen processing section 226 is changed, the controller 20 moves to the process at S80. If the type of the recording sheet 42 or the type of the screen applied by the screen processing section 226 is not changed, the controller 20 moves to a process at S90. Specifically, the printer device 10 forcibly inserts the calibration job that is suitable for the printing process after the change (i.e., the following printing process), to allow the color calibration process to interrupt, if the printing condition (the type of the recording sheet 42 used for the printing or the type of the screen applied by the screen processing section 226) is changed.

At the step 80 (S80), the printer device 10 permits the printing process of the test image (calibration job) to interrupt during the execution of the printing process requested by the user, thereby performing the color calibration process based upon the test image printed on the recording sheet 42.

At a step 90 (S90), the controller 20 determines whether a non-processed job (normal job) is present or not. If the non-processed job is present, the controller 20 returns to the S50 to perform the printing process for the following jobs. If the non-process job is not present (i.e., if there is no jobs waiting to be processed), the printing process (S1) is ended.

Figure 7:
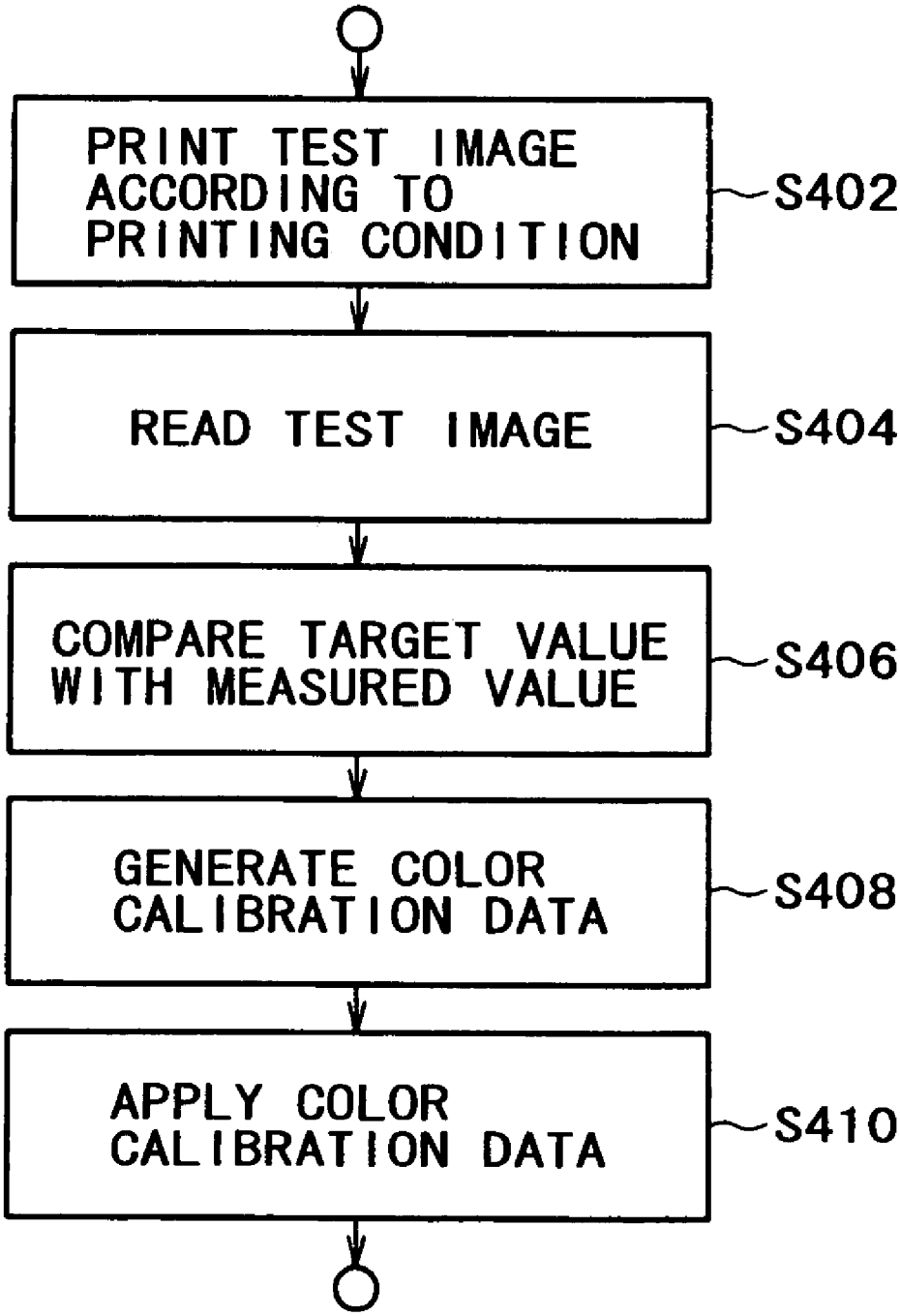
FIG. 7 is a flowchart for explaining in detail a color calibration process (S40) before printing is started.

FIG. 7 is a flowchart for explaining in detail the color calibration process (S40) before the printing is started.

As shown in FIG. 7, when the insertion of the color calibration process is decided based upon the accumulated printing number, the data obtaining section 200 selects, from among the plural test patterns 426 (FIG. 2) stored in the test image storing section 204, the test pattern 426 of the mixed color that is used in the following printing process in an amount equal to or larger than the fixed amount, and reads the image data of the selected test pattern 426 from the test image storing section 204. Further, the data obtaining section 200 sets the operation mode of the calibration job for printing the test image under the same printing condition (the type of the recording sheet and the type of the screen) as the following printing process, and allows the calibration job to interrupt before the normal job.

The printer device 10 transfers the toner image for the test formed of the test pattern 426 onto the recording sheet 42 according to the calibration job produced by the data obtaining section 200, thereby performing the fixing process.

At a step 404 (S404), after being subject to the fixing process by the fixing device 19, the recording sheet 42 having the test toner image transferred thereon is fed to the second branch position on the sheet discharge path 310 and directed by the second changeover plate 344 to the purge path 330 to be fed to the purge tray 354.

The colorimetric sensor 302 mounted on the sheet discharge path 310 reads the test image from the recording sheet 42 that is being fed on the sheet discharge path 310, and outputs the read test image to the calibration value deciding section 232.

At a step 406 (S406), the calibration value deciding section 232 measures the characteristic amount of this test image based upon the test image inputted from the calorimetric sensor 302, whereupon it compares the measured characteristic amount with the preset reference value (target value) for calculating the difference value between these.

At a step 408 (S408), the calibration value deciding section 232 generates calibration data, that specifies the color calibration amount, according to the calculated difference value, and outputs this calibration data to the color balance adjusting section 234.

At a step 410 (S410), the color balance adjusting section 234 immediately renews the tone correction data memorized in the tone correcting section 220 based upon the calibration data inputted from the calibration value deciding section 232. Specifically, the printer device 10 applies the result of the color calibration process before the requested image is started to be printed in the color calibration process before the printing is started.

Figure 8:
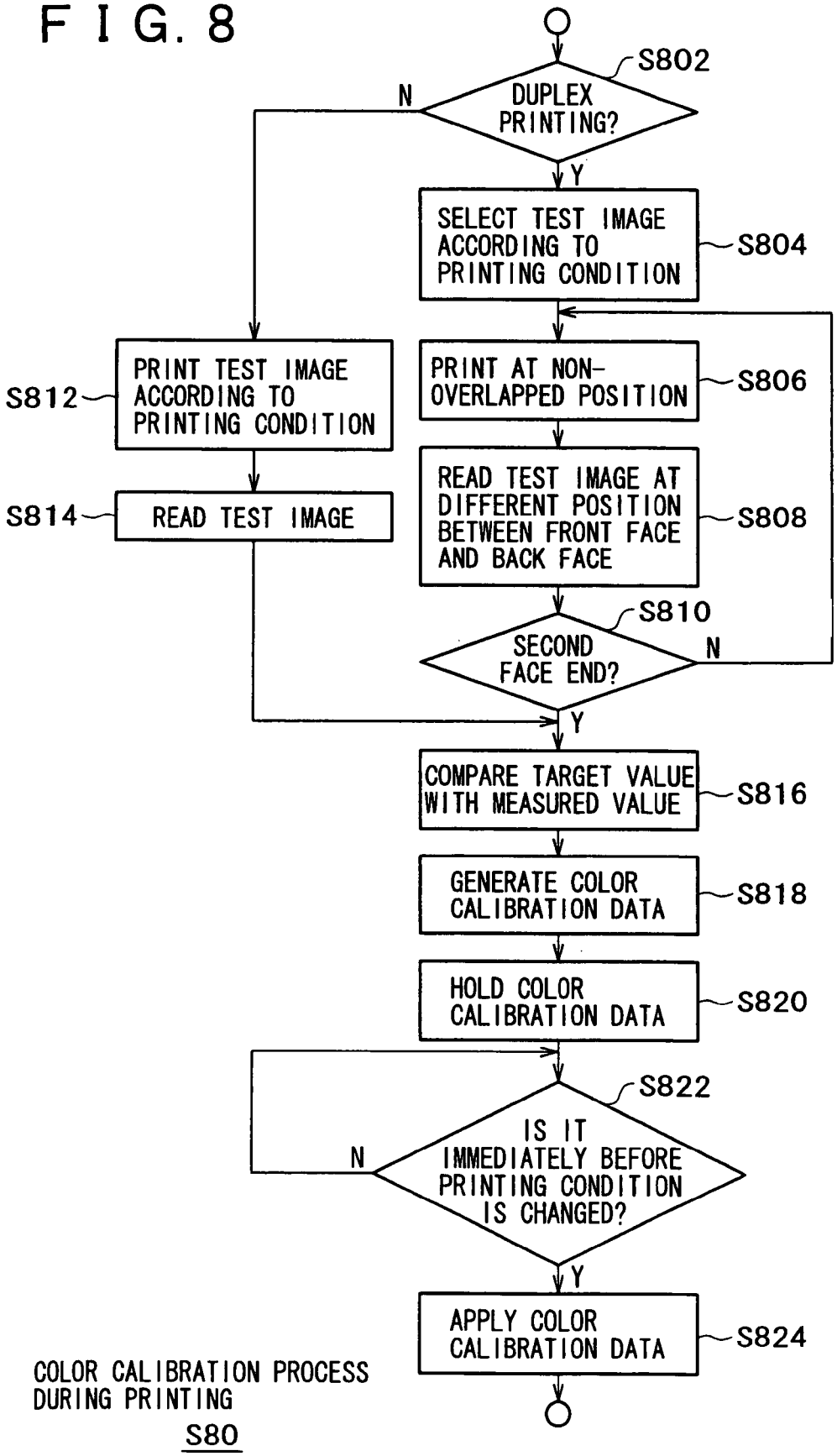
FIG. 8 is a flowchart for explaining in detail a color calibration process (S80) during the printing.

FIG. 8 is a flowchart for explaining in detail the color calibration process (S80) during the printing.

As shown in FIG. 8, when the insertion of the color calibration process is decided based upon the change in the accumulated printing number or the printing condition, the data obtaining section 200 determines the operation mode of the normal job before and after the insertion and applies the same operation mode to the calibration job at a step 802 (S802). Further, the data obtaining section 200 determines whether or not the operation mode that should be applied to the calibration job is the duplex printing mode.

If the duplex printing mode is applied to the calibration job, the controller 20 moves to a process at S804. If the mode other than the duplex printing mode is applied, it moves to a process at S812.

At the step 804 (S804), the data obtaining section 200 selects, from among the plural test patterns 426 (FIG. 2) stored in the test image storing section 204, the test pattern 426 of the mixed color that is used in the following printing process in an amount equal to or larger than the fixed amount, and reads the image data of the selected test pattern 426 from the test image storing section 204. Further, the data obtaining section 200 sets the operation mode of the calibration job for printing the test image under the same printing condition (the type of the recording sheet and the type of the screen) as the following printing process, and allows the calibration job to interrupt before the normal job.

At a step 806 (S806), the printer device 10 transfers the test toner image having the test pattern 426 arranged at the fixed position on the recording sheet 42 according to the calibration job generated by the data obtaining section 200 and performs the fixing process. The fixed position on which the test pattern 426 is arranged is a printing position decided such that the test pattern printed on the first surface and the test pattern printed on the second surface do not overlap with each other. In the printer device 10 in this embodiment, the image data having the test pattern arranged on the fixed position is memorized in the test image storing section 204 as the test image that should be applied for the duplex printing.

At a step 808 (S808), the recording sheet 42 having the test toner image transferred thereon is subject to the fixing process by the fixing device 19, and then, fed to the first branch position on the sheet discharge path 310.

The colorimetric sensor 302 mounted on the sheet discharge path 310 reads the test image from the recording sheet 42 that is being fed on the sheet discharge path 310 and outputs the read test image to the calibration value deciding section 232. It should be noted that, according to the control of the read controlling section 206, the colorimetric sensor 302 moves in the fast-scanning direction (the direction perpendicular to the sheet transferring direction) to read the test image printed on the second surface after reading the test image printed on the first surface.

The controller 20 determines whether the printing process on the second surface (back surface) is completed or not at a step 810 (S810). If the printing process on the second surface is completed, the sheet transfer controlling section 208 controls the first changeover plate 342 and the second changeover plate 344 to transfer the recording sheet 42 to the purge tray 354, and then, moves to a process at S816. Further, if the printing process on the second surface is not completed, the sheet transfer controlling section 208 controls the first changeover plate 342, whereby the recording sheet 42 is fed to the sheet reversing path 320 to be reversed and is again fed to the secondary transfer position. Then, it returns to a process at S806.

At a step 812 (S812), the data obtaining section 200 selects, from among the plural test patterns 426 (FIG. 2) stored in the test image storing section 204, the test pattern 426 of the mixed color that is used in the following printing process in an amount equal to or larger than the fixed amount, and reads the image data of the selected test pattern 426 from the test image storing section 204. Further, the data obtaining section 200 sets the operation mode of the calibration job for printing the test image under the same printing condition (the type of the recording sheet and the type of the screen) as the following printing process, and allows the calibration job to interrupt before the normal job.

The printer device 10 transfers the test toner image formed of the test pattern 426 onto the recording sheet 42 according to the calibration job produced by the data obtaining section 200, thereby performing the fixing process.

At a step 814 (S814), after being subject to the fixing process by the fixing device 19, the recording sheet 42 having the test toner image transferred thereon is discharged onto the purge tray 354 through the sheet discharge path 310 and the purge path 330.

The colorimetric sensor 302 mounted on the sheet discharge path 310 reads the test image from the recording sheet 42 that is being fed on the sheet discharge path 310, and outputs the read test image to the calibration value deciding section 232.

At a step 816 (S816), the calibration value deciding section 232 measures the characteristic amount of this test image based upon the test image inputted from the colorimetric sensor 302, whereupon it compares the measured characteristic amount with the preset reference value (target value) for calculating the difference value between these.

At a step 818 (S818), the calibration value deciding section 232 generates, according to the calculated difference value, calibration data that specifies the color calibration amount, and outputs this calibration data to the color balance adjusting section 234.

At a step 820 (S820), the color balance adjusting section 234 stores the calibration data inputted from the calibration value deciding section 232 to the calibration data storing section 236. It should be noted that the printer device 10 restarts the printing process of the requested image after the printing process of the test image is completed.

At a step 822 (S822), if it is immediately before the printing condition (the type of the recording sheet 42 or the type of the screen) is changed during the printing process of the requested image, the color balance adjusting section 234 moves to a process at S824. In case it is not immediately before the printing condition is changed, it stands by.

At a step 824 (S824), the color balance adjusting section 234 renews the tone correction table memorized in the tone correcting section 220 based upon the calibration data inputted from the calibration value deciding section 232.

Specifically, the color balance adjusting section 234 reflects the result of the color calibration process on all colors at the timing immediately before the printing condition is changed. The printer device 10 reflects the result of the color calibration process at a timing when the printing condition is changed, thereby being capable of making the change in the color balance by the color calibration process unnoticeable.

As explained above, the printer device 10 in this embodiment prints the test image, during the printing process requested by the user, onto another recording sheet than the one on which the requested image is to be printed, and performs the color calibration process based upon this test image during the printing process. This allows the printer device 10 to correct the fluctuation in the color development property generated during the successive printing process, thereby being capable of keeping the color balance of the output image almost constant.

Further, if the duplex printing is designated for the requested image, the printer device 10 also designates the duplex printing for the calibration job, resulting in preventing the reduction in productivity due to the change in the operation mode. Moreover, the printer device 10 reads the same test image printed on both sides of the recording sheet 42, thereby being capable of enhancing the reading precision of the test image.

In the abovementioned embodiment, there may be the case where the stabilized operation cannot be assured due to the influence of heat generated in the fixing process because the colorimetric sensor 302 is disposed right next to the fixing device 19. Therefore, the printer device 10 may have a fan (cooling unit) for cooling the calorimetric sensor 302. Further, the printer device 10 may have a heat insulating material mounted between the fixing device 19 and the colorimetric sensor 302. Specifically, in the printer device 10, direct transmission of heat to the calorimetric sensor 302 from the fixing device 19 is prevented by the heat insulating material, and the heat transmitted from the calorimetric sensor 302 via the recording sheet 42 is cooled by the cooling fan.

If an image is formed onto a recording sheet wherein the sheet material (surface property) is different between the front surface and the back surface (for example, one-side coated paper and the like), the printer device 10 may use plural recording sheets to read a test image formed on the front surface and a test image formed on the back surface, wherein the color calibration process may be performed based upon the test image read from the respective surfaces. Specifically, the printer device 10 forms and reads a test image onto the front surface of one recording sheet and forms and reads a test image onto the back surface of another recording sheet. Further, if an image is formed onto a recording sheet wherein the sheet material is different between the front surface and the back surface, the printer device 10 may form a test image on both sides of one recording sheet such that a test image formed on the front surface is not overlapped with the test image formed on the back surface as shown in FIG. 3 or FIG. 4, wherein the color calibration process may be performed based upon the formed test image.

Subsequently, the second embodiment will be explained.

Figure 9:
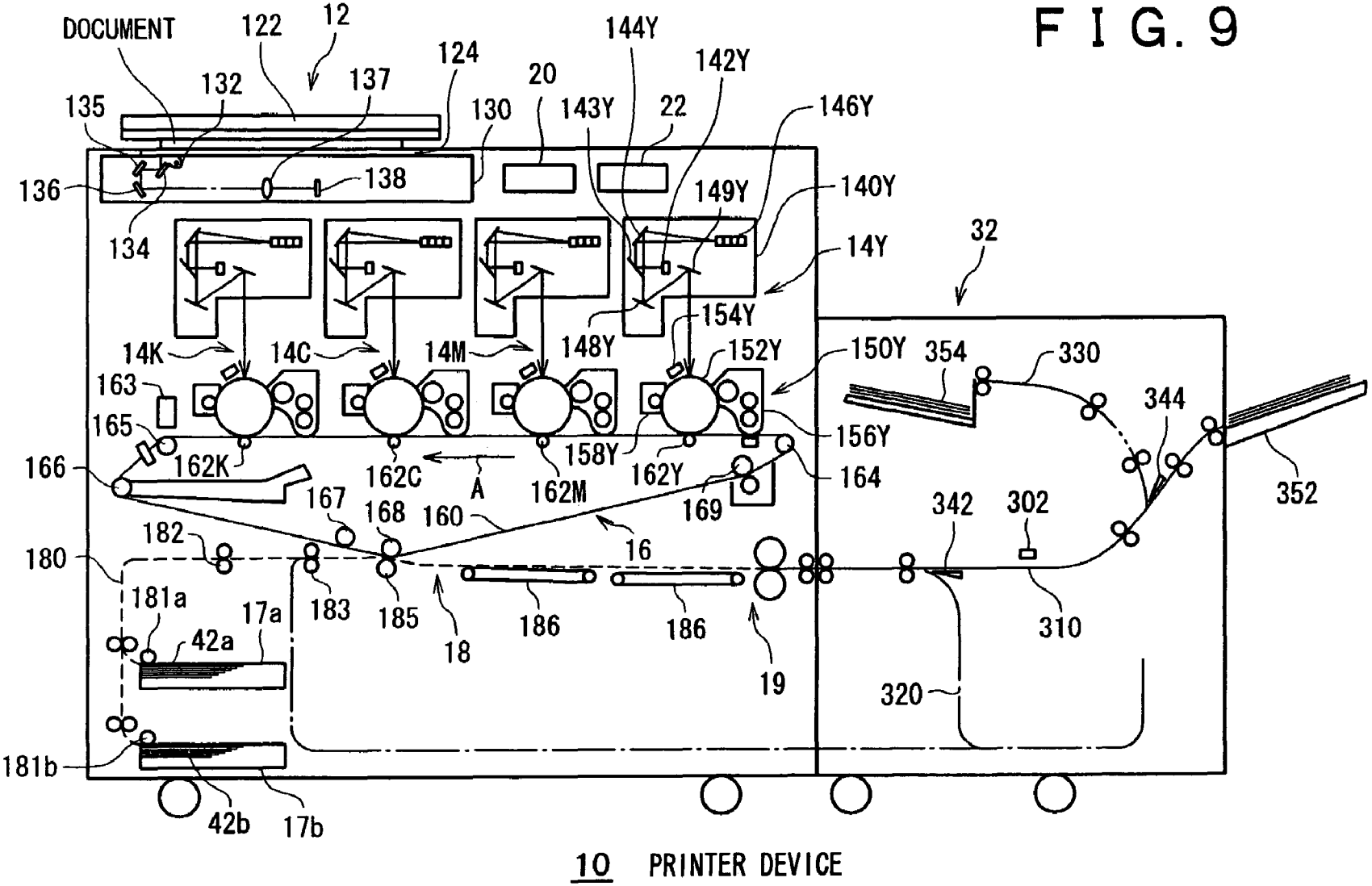
FIG. 9 is a view showing a construction of a printer device 10 in a second embodiment.

FIG. 9 is a view showing a construction of a printer device 10 according to the second embodiment. It should be noted that the components shown in this figure that are substantially the same as those shown in FIG. 1 are given the same numerals.

As illustrated in FIG. 9, the printer device 10 in the second embodiment is different from the printer device in the first embodiment in that it has a second post-processing device 32. More specifically, the second post-processing device 32 is different from the first post-processing device 30 in that it has the calorimetric sensor 302 mounted between the first branch position (the position where the first changeover plate 342 is disposed) and the second branch position (the position where the second changeover plate 344 is disposed). Specifically, the calorimetric sensor 302 is disposed at the more downstream position than the calorimetric sensor in the first embodiment, so that it is hard to be affected by heat generated during the fixing process.

The calorimetric sensor 302 is mounted at the upper side of the sheet discharge path 310 so as to be able to read the test image from the recording sheet 42 with the face-up output.

Figure 10:
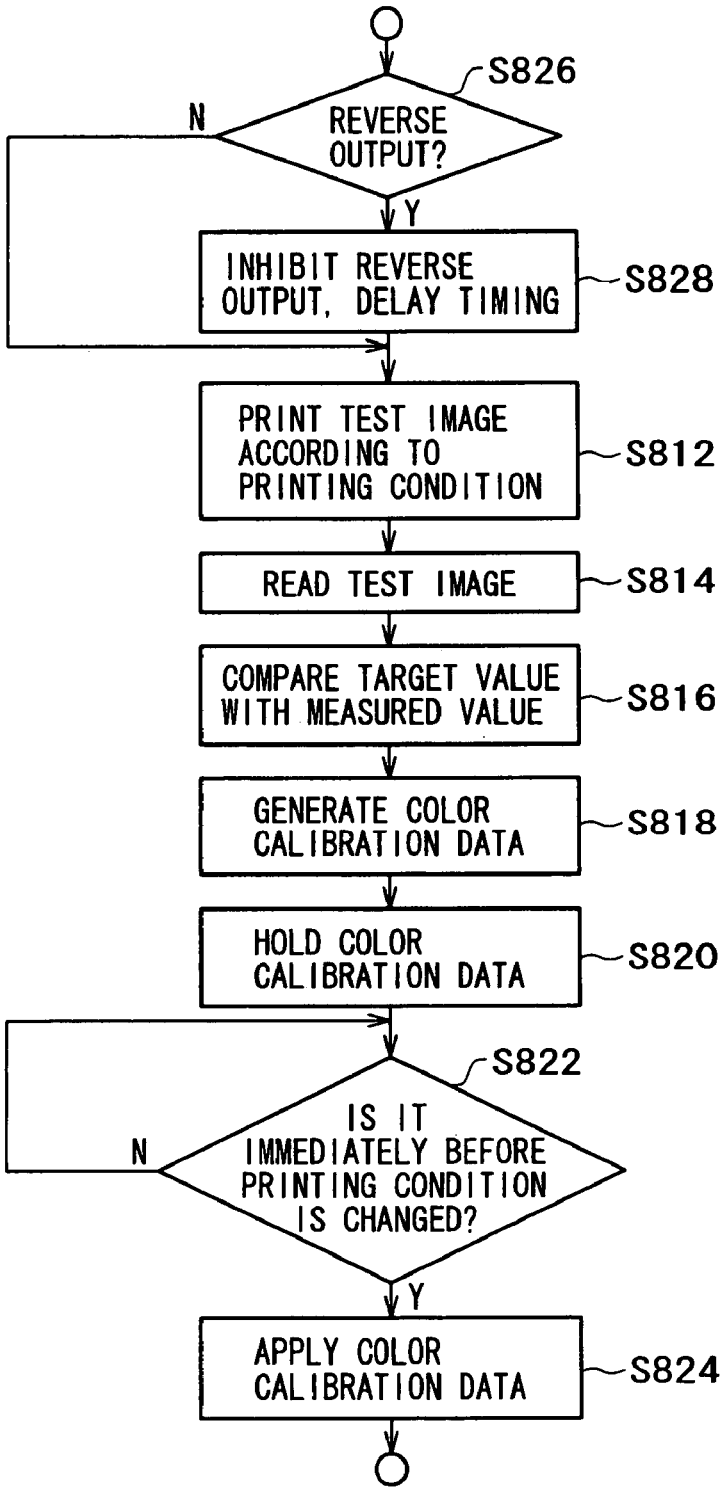
FIG. 10 is a flowchart for explaining a second color calibration process (S82) in the second embodiment.

FIG. 10 is a flowchart for explaining the second color calibration process (S82) in the second embodiment. It should be noted that the processes shown in this figure that are substantially the same as those shown in FIG. 8 are given the same numerals.

As shown in FIG. 10, when the color calibration process is determined to be inserted based upon the change in the accumulated printing number or the printing condition, the data obtaining section 200 selects at a step 826 (S826) a test pattern 426 of mixed colors used in an amount equal to or larger than the fixed amount in the following printing process, and then, reads the image data of the selected test pattern 426 from the test image storing section 204 to generate a calibration job. Further, the data obtaining section 200 sets the operation mode of the calibration job for printing the test image under the printing condition (the type of the printing sheet or the type of the screen) that is the same as that in the subsequent printing process.

Subsequently, the data obtaining section 200 determines the operation mode of the normal jobs before and after the calibration job, wherein it applies, to the calibration job, the sheet transferring method that is the same as that in at least one of the jobs. Moreover, the data obtaining section 200 determines whether or not the sheet transferring method that should be applied to the calibration job is the reverse output mode. The reverse output mode here means an operation mode for transferring the sheet wherein the reversing process is performed for the recording sheet 42. For example, the duplex printing mode and the face-down output mode correspond to the reverse output mode.

If the duplex printing mode or the face-down output mode is applied to the calibration job, the controller 10 moves to a process at S828, while it moves to a process at S812 if the mode other than the duplex printing mode is applied.

At the step 828 (S828), the controller 20 delays the insertion of the calibration job so as not to hinder the printing process (involving the reversing process) preceding this calibration job. More specifically, the data obtaining section 200 delays the timing for inserting the calibration job by as long as it takes the sheet to be introduced into the sheet reversing path 320 at the first branch position and fed again to the first branch position, thereby increasing the space between the preceding recording sheet 42 and the recording sheet 42 on which the test image is to be printed. The read controlling section 206 and the sheet transfer controlling section 208 respectively delay the timing for reading the test image and the timing for starting the sheet transfer controlling section 208 of the recording sheet 42 on which the test image is to be printed according to the delay of the timing for inserting the calibration job by the data obtaining section 200.

Further, the sheet transfer controlling section 208 inhibits the reverse output in the calibration job. This makes it possible that the sheet transfer device 18 transfers, according to the control of the sheet transfer controlling section 208, the recording sheet 42 having the test image printed thereon to the purge tray 354 via the sheet discharge path 310 and the purge path 330 without passing through the sheet reversing path 320. It should be noted that the sheet transfer controlling section 208 may cause the recording sheet 42 having the test image printed thereon to be fed to the exit tray 352.

At S812, the printer device 10 transfers the test toner image formed of the test pattern 426 onto the recording sheet 42 and applies the fixing process according to the calibration job inserted by the controller 20.

As explained above, the printer device 10 according to the second embodiment has the calorimetric sensor 302 mounted between the first branch position and the second branch position, whereby the reversing process by the sheet reversing path 320 is inhibited for the recording sheet 42 on which the test image is to be printed, thereby making it possible to read the test image.

Further, if the reversing process involved with the duplex printing or the face-down output is performed in the preceding printing process of the normal job, the printer device 10 in this embodiment delays the insertion of the calibration job to offset the difference in the processing time between the preceding normal job and the inserted calibration job.

Subsequently, a modified embodiment of the second embodiment will be explained.

In the abovementioned second embodiment, the printer device 10 inhibits the reversing process in the calibration job, and further, if the preceding normal job is in the reverse output mode, it delays the insertion of this calibration job to make it possible to read the test image with the minimum influence to the normal job.

The printer device 10 in this modified embodiment prints a test image on a second surface if the preceding normal job is in the duplex printing mode. This enables the printer device 10 to process the preceding normal job and the inserted calibration job in the same operation mode, and further, this makes it possible to read the test image by the calorimetric sensor 302 (FIG. 9).

Figure 11:
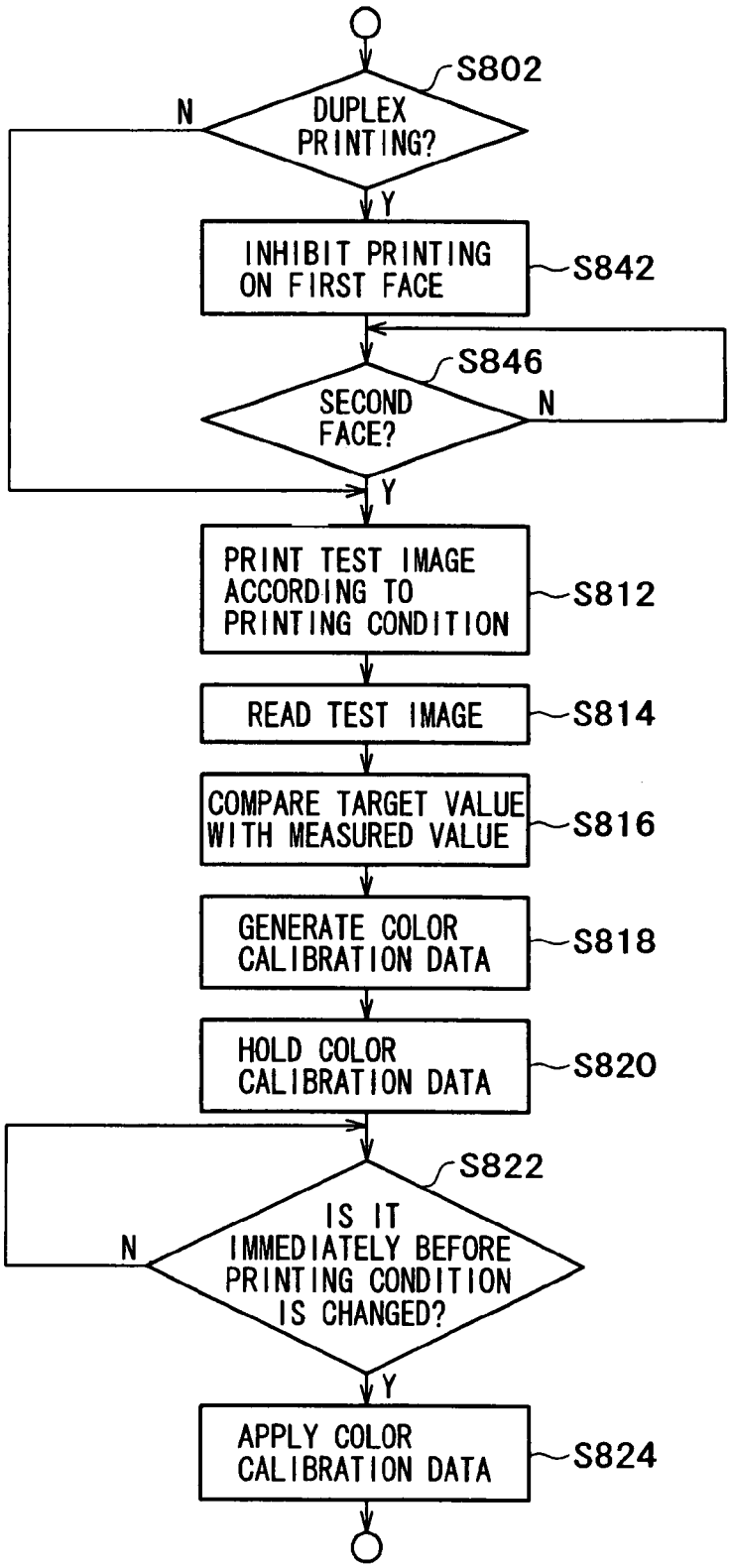
FIG. 11 is a flowchart for explaining a third color calibration process (S84) in a modified embodiment.

FIG. 11 is a flowchart for explaining a third color calibration process (S84) in this modified embodiment. It should be noted that the processes in each process shown in this figure that are substantially the same as those shown in FIG. 8 are given the same numerals.

As shown in FIG. 11, when the color calibration process is determined to be inserted based upon the change in the accumulated printing number or the printing condition, the data obtaining section 200 selects, from among plural test patterns 426 stored in the test image storing section 204 (FIG. 2), a test pattern 426 of mixed colors used in an amount equal to or larger than the fixed amount in the subsequent printing process, and then, reads the image data of the selected test pattern 426 from the test image storing section 204 at a step 802 (S802). Further, the data obtaining section 200 sets the operation mode of the calibration job for printing the test image under the printing condition (the type of the printing sheet or the type of the screen) that is the same as that in the subsequent printing condition.

Subsequently, the data obtaining section 200 determines the operation mode of the normal jobs before and after the calibration job, wherein it applies, to the calibration job, the sheet transferring method that is the same as that in at least one of the jobs. Moreover, the data obtaining section 200 determines whether or not the sheet transferring method that should be applied to the calibration job is the duplex printing mode.

If the duplex printing mode is applied to the calibration job, the controller 10 moves to a process at S842. If the mode other than the duplex printing mode is applied, it generates the calibration job based upon the read test image, whereupon it inserts this calibration job, and then, moves to a process at S812.

At a step 842 (S842), the data obtaining section 200 inhibits the printing on the first surface, generates the calibration job wherein the test pattern 426 read from the test image storing section 204 is defined as the image data that should be printed on the second surface, and then, allows the generated calibration job to interrupt between the normal jobs.

At a step 844 (S844), the printer device 10 starts the printing process according to the calibration job generated by the data obtaining section 200. Specifically, if the area on which the toner image is transferred is the first surface of the recording sheet 42, the printer device 10 inhibits the toner image forming process and the transfer process to transfer the recording sheet 42 to the sheet reversing path 320 for reversing the sheet 42 without transferring the toner image onto the first surface of the recording sheet 42. If the area on which the toner image is transferred is the second surface of the recording sheet 42, the program moves to a process at S812.

At the step 812 (S812), the printer device 10 transfers the test toner image formed of the test pattern 426 onto the recording sheet 42 and applies the fixing process according to the calibration job. Specifically, in the case of the duplex printing mode, the printer device 10 prints the test image onto the second surface of the recording sheet 42, while in the case of the one-sided printing mode, it prints the test image onto the first surface of the recording sheet 42.

At S814, the recording sheet 42 having the test toner image transferred thereon is subject to the fixing process by the fixing device 19, and then, fed through the sheet discharge path 310, wherein the colorimetric sensor 302 disposed on this sheet discharge path 310 reads the test image from the recording sheet 42 that is being fed.

As described above, the printer device 10 in this modified embodiment applies the duplex printing mode also to the calibration job that is to be inserted for printing the test image onto the second surface of the recording sheet 42, if the normal jobs before and after the calibration job are in the duplex printing mode. This enables the printer device 10 to print and read the test image without changing the operation mode.

If an image is formed onto a recording sheet wherein the sheet material (surface property) is different between the front surface and the back surface (for example, one-side coated paper and the like), it is required that the test image is formed on the respective surfaces to perform the color calibration process based upon the formed test image because the color development characteristic is different between the respective surfaces. Therefore, the printer device 10 in this embodiment uses plural recording sheets to read a test image formed on the front surface and a test image formed on the back surface, wherein the color calibration process may be performed based upon the test image read from the front surface of any one of the recording sheets and the test image read from the back surface of any of the other recording sheets. Specifically, the printer device 10 forms a test image onto the front surface of one recording sheet and reads the formed test image from the front surface of this recording sheet by the process shown in FIG. 10, while it forms a test image onto the back surface of the other recording sheet and reads the formed test image from the back surface of this recording sheet by the process shown in FIG. 11.

Subsequently, the third embodiment will be explained.

Figure 12:
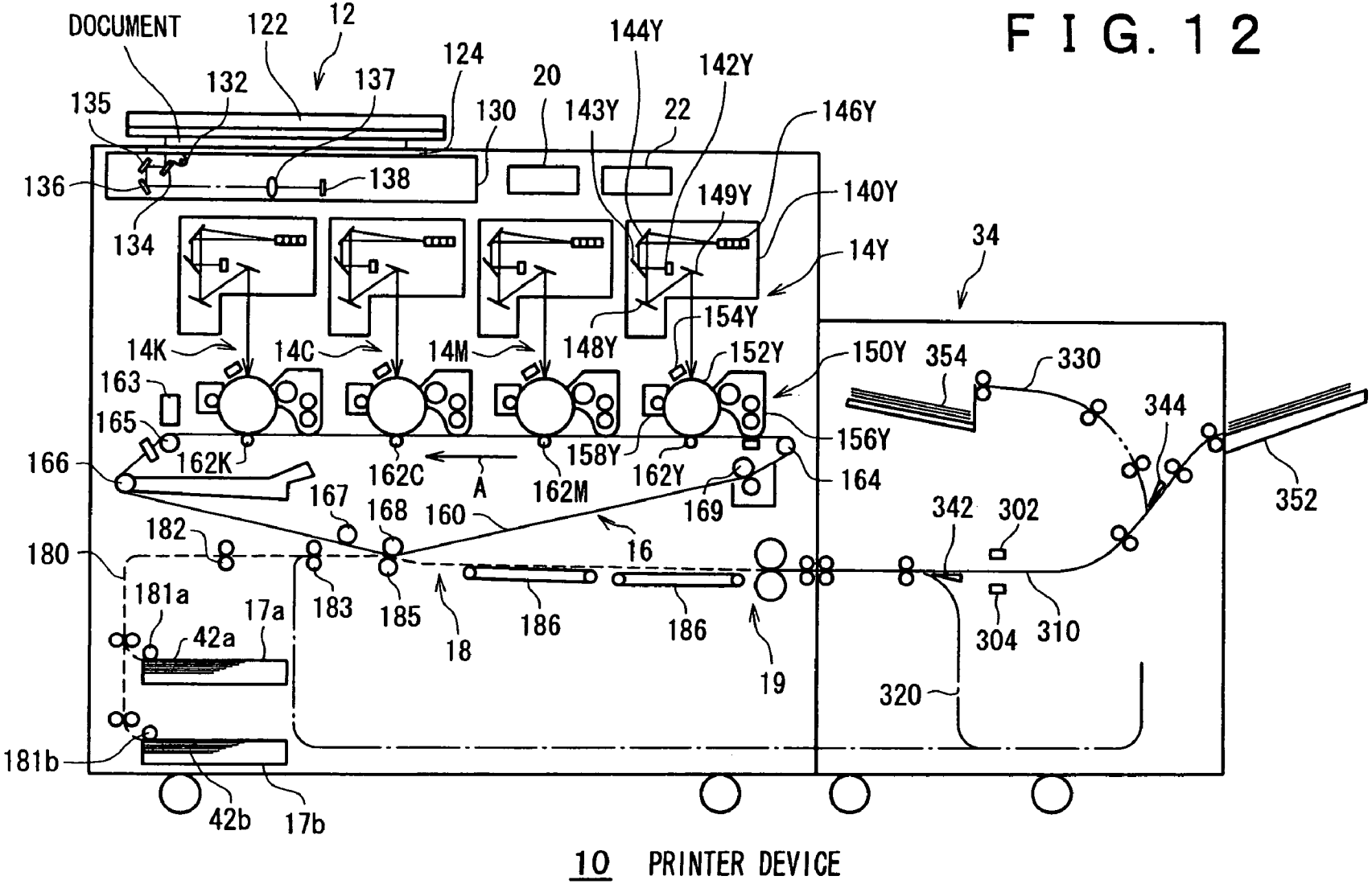
FIG. 12 is a view showing a construction of a printer device 10 in a third embodiment.

FIG. 12 is a view showing a construction of the printer device 10 according to the third embodiment. It should be noted that the components shown in this figure that are substantially the same as those shown in FIG. 1 are given the same numerals.

As illustrated in FIG. 12, the printer device 10 in the third embodiment is different from the printer device in the first embodiment mainly in that it has a third post-processing device 34. More specifically, the third post-processing device 34 is different from the first post-processing device 30 in that it has a first colorimetric sensor 302 and a second colorimetric sensor 304 disposed between the first branch position and the second branch position.

The first colorimetric sensor 302 is disposed at the upward side of the sheet discharge path 310 so as to be able to read the test image from the recording sheet 42 with the face-up output, while the second colorimetric sensor 304 is disposed at the downward side of the sheet discharge path 310 so as to be able to read the test image from the recording sheet 42 with the face-down output. Specifically, the post-processing device 34 in this embodiment can read the test image from both surfaces (front surface and back surface) without reversing the recording sheet 42.

Accordingly, the controller 20 in this embodiment applies the sheet transferring method that is the same as that in at least one of the normal jobs before or after the calibration job to generate the calibration job, wherein the generated calibration job can be inserted without being delayed.

If the duplex printing mode is applied to the calibration job, for example, the controller 20 may cause the test image to be printed on only the first surface. In this case, the read controlling section 206 makes the second colorimetric sensor 304 read the test image on the first surface.

Further, the controller 20 may cause the test image to be printed on the first surface and the second surface. In this case, the read controlling section 206 makes the second calorimetric sensor 304 read the test image on the first surface and makes the first colorimetric sensor 302 read the test image on the second surface. Since there may be a difference between the reading ability of the first calorimetric sensor 302 and the reading ability of the second colorimetric sensor 304, the printer device 10 is required to reflect the correlation between the reading result by the first calorimetric sensor 302 and the reading result by the second calorimetric sensor 304 on the color calibration process.

FIG. 13 is a view illustrating a calibration table that is referred to if the calibration value deciding section 232 decides the calibration value (calibration data).

As illustrated in FIG. 13, the calibration value deciding section 232 has a calibration table that associates the type of the recording sheet, the type of the screen, identification information of a test image and a combination of difference data with each calibration value (calibration data). The difference data is data showing the difference between the characteristic amount of the test image printed on the recording sheet 42 and the reference characteristic amount set as a target value for the color calibration. Further, the calibration value is a value for adjusting the color development characteristic of the printer device 10 so as to decrease the corresponding difference.

Moreover, the calibration value deciding section 232 has respective calibration tables that respectively associate with the first calorimetric sensor 302 and the second calorimetric sensor 304. Each calibration table corresponding to the colorimetric sensor 302 and the calorimetric sensor 304 includes the calibration value calculated so as to offset the device error of each colorimetric sensor. Accordingly, the printer device 10 can implement almost the same color calibration even if the color calibration process is performed based upon the test image read by the first colorimetric sensor 302 or based upon the test image read by the second colorimetric sensor 304.

Although the printer device 10 in this embodiment prepares in advance the calibration value for the respective calorimetric sensors, the invention is not limited thereto. For example, the characteristic amount of the test image or the calibration value (calibration data) may be corrected so as to offset the device error by use of the correlation value between the measured result by the first calorimetric sensor 302 and the measured result by the second colorimetric sensor 304 every time the test image is read.

Figure 14:
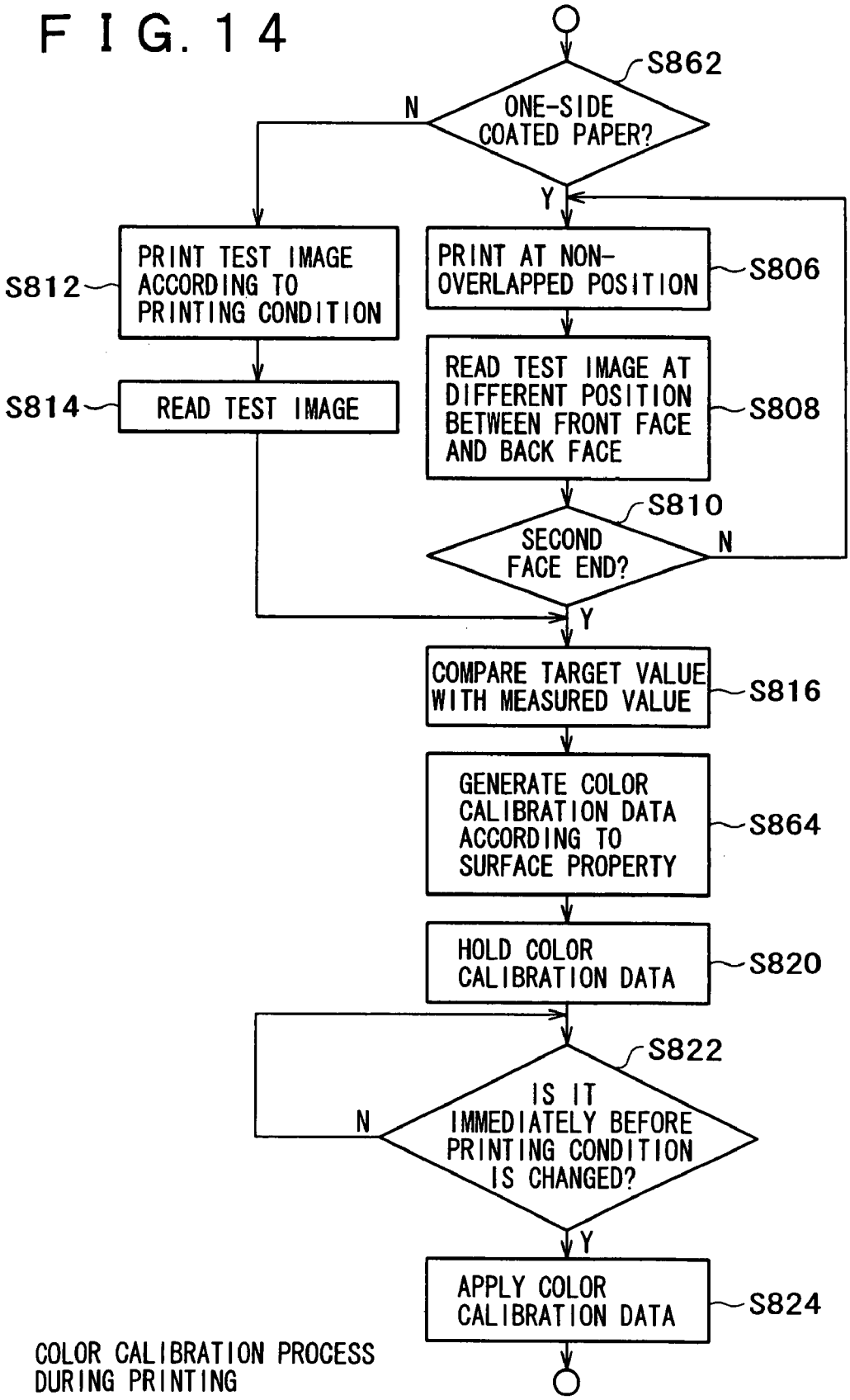
FIG. 14 is a flowchart for explaining a third color calibration process (S86) in the third embodiment.

FIG. 14 is a flowchart for explaining the third color calibration process (S86) in the third embodiment. It should be noted that the processes shown in this figure that are substantially the same as those shown in FIG. 8 are given the same numerals.

As shown in FIG. 14, when the color calibration process is determined to be inserted based upon the change in the accumulated printing number or the printing condition, the data obtaining section 200 selects at a step 826 (S826) a test pattern 426 of mixed colors used in an amount equal to or larger than the fixed amount in the subsequent printing process, and then, reads the image data of the selected test pattern 426 from the test image storing section 204 to generate a calibration job. Further, the data obtaining section 200 sets the operation mode of the calibration job for printing the test image under the printing condition (the type of the printing sheet or the type of the screen) that is the same as that in the subsequent printing condition.

Subsequently, the data obtaining section 200 determines the operation mode of the normal jobs before and after the calibration job, wherein it applies the same sheet transferring method to the calibration job. Moreover, the data obtaining section 200 determines whether or not the operation mode that should be applied to the calibration job is a sheet material designating mode. The sheet material designating mode here means the operation mode wherein the printing is performed by changing the printing condition according to the surface state of the recording sheet 42 used for the printing. It is applied, for example, to the case where the recording sheet 42 other than a normal sheet is designated by a user. When the sheet material designating mode is set, there may be the case where the front surface and the back surface of the recording sheet 42 have different surface states like one-side coated paper. Therefore, if the sheet material designating mode is designated, the printer device 10 in this embodiment performs the color calibration process to both surfaces of the recording sheet 42.

Specifically, if the sheet material designating mode is applied to the calibration job (i.e., if the recording sheet having different surface states between the front surface and the back surface (e.g., one-side coated paper) is applied), the controller 20 moves to a process at S804. If the sheet designating mode is not applied (i.e., if a default recording sheet (e.g., normal sheet) is used), the controller 20 inserts the calibration job and moves to a process at S812 to print the test image only on one surface.

From S804 to S810, the printer device 10 prints the test image on both surfaces of the recording sheet 42, whereby it causes the first colorimetric sensor 302 and the second colorimetric sensor 304 to read the test image from the front surface and the back surface of the recording sheet 42.

At S816, the calibration value deciding section 232 measures the characteristic amount of the respective test images based upon the image data of the test image inputted from the first colorimetric sensor 302 and the second calorimetric sensor 304 and compares the measured characteristic amount with the reference value to calculate the difference value.

At a step 864 (S864), the calibration value deciding section 232 reads the calibration data corresponding to the calorimetric sensor and the sheet (the surface state of the recording sheet) from the calibration table (FIG. 13) according to the respective calculated difference values, whereupon it outputs the calibration data to the color balance adjusting section 234.

As explained above, the printer device 10 in the third embodiment has the first colorimetric sensor 302 and the second colorimetric sensor 304 between the first branch position and the second branch position, thereby being capable of reading the test image without changing the operation mode even if the face-down output or the duplex printing mode is designated.

Further, even if the recording sheet 42 having the different surface states between the front surface and the back surface is used, the printer device 10 in this embodiment prints the test image on both surfaces and can read each test image almost simultaneously.

Subsequently, the fourth embodiment will be explained.

Figure 15:
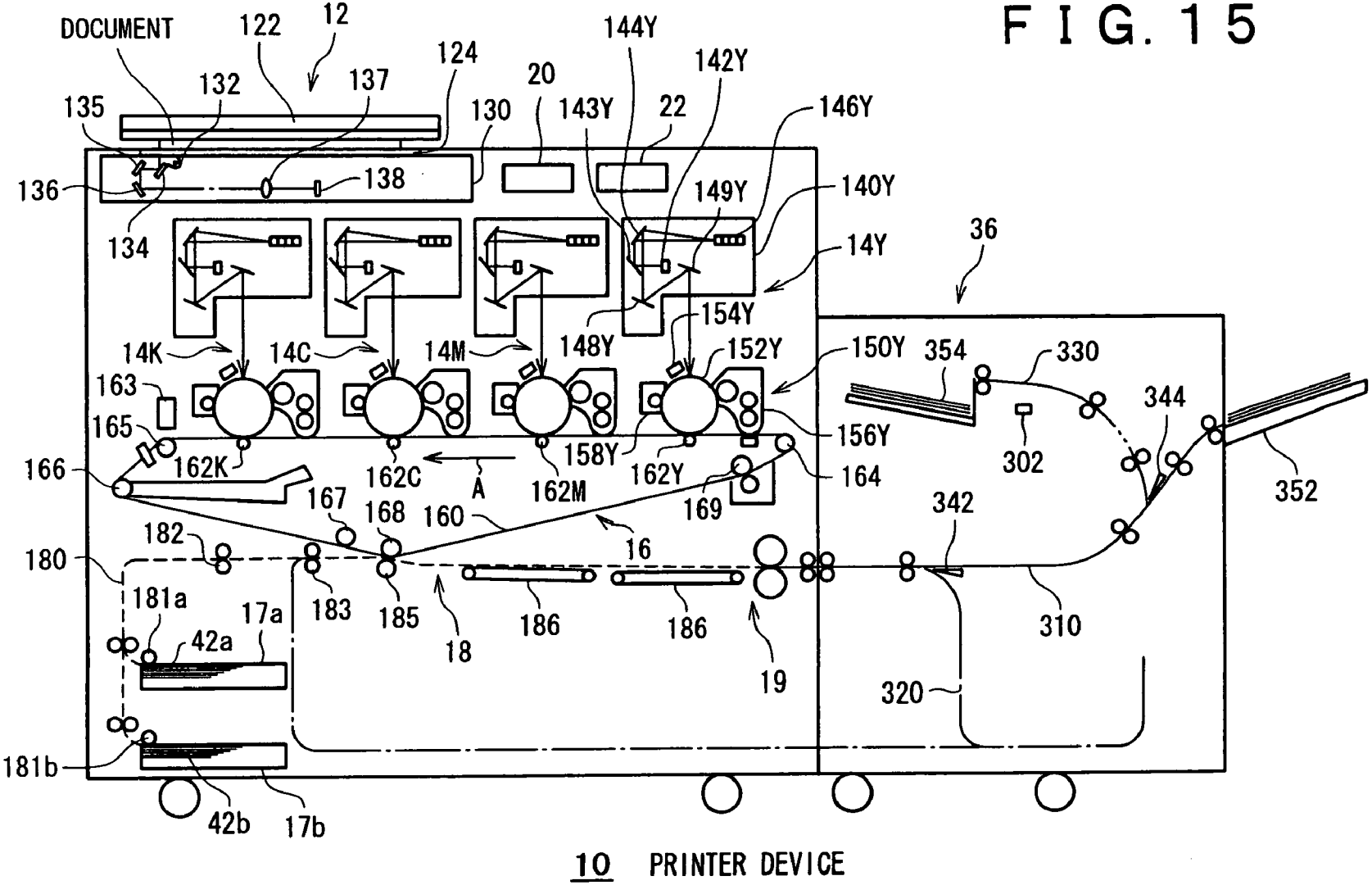
FIG. 15 is a view showing a construction of a printer device 10 in a fourth embodiment.

FIG. 15 is a view showing a construction of a printer device 10 in the fourth embodiment. It should be noted that the components shown in this figure that are substantially the same as those shown in FIG. 1 are given the same numerals.

As illustrated in FIG. 15, the printer device 10 in the fourth embodiment is different from the printer device in the first embodiment in that it has a fourth post-processing device 36. More specifically, the fourth post-processing device 36 is different from the first post-processing device 30 in that it has the calorimetric sensor 302 on the purge path 330. Specifically, the colorimetric sensor 302 in this embodiment is disposed in the vicinity of the discharge port to the purge tray 354 for reading the test image from the recording sheet 42 that is fed through the purge path 330.

The purge path 330 is a sheet transfer path for transferring the recording sheet 42 that should be disposed, so that it is branched at the second branch position from the sheet discharge path 310 through which the recording sheet 42 having the requested image printed thereon is fed. Therefore, the transferring speed of the recording sheet 42 introduced into the purge path 330 can be slower than the transferring speed of the recording sheet on the sheet discharge path 310.

When the recording sheet 42 having the test image printed thereon is introduced into the purge path 330, the controller 20 makes the transferring speed of this recording sheet 42 slower than the transferring speed on the sheet discharge path 310 at least in the vicinity of the calorimetric sensor 302. More specifically, when the calibration job is inserted, the sheet transfer controlling section 208 (FIG. 5) in the controller 20 temporarily stops the recording sheet 42, having the test image printed thereon, at the reading position by the calorimetric sensor 302.

This can enhance the reading precision of the test image by the colorimetric sensor 302 in the printer device 10.

Figure 16:
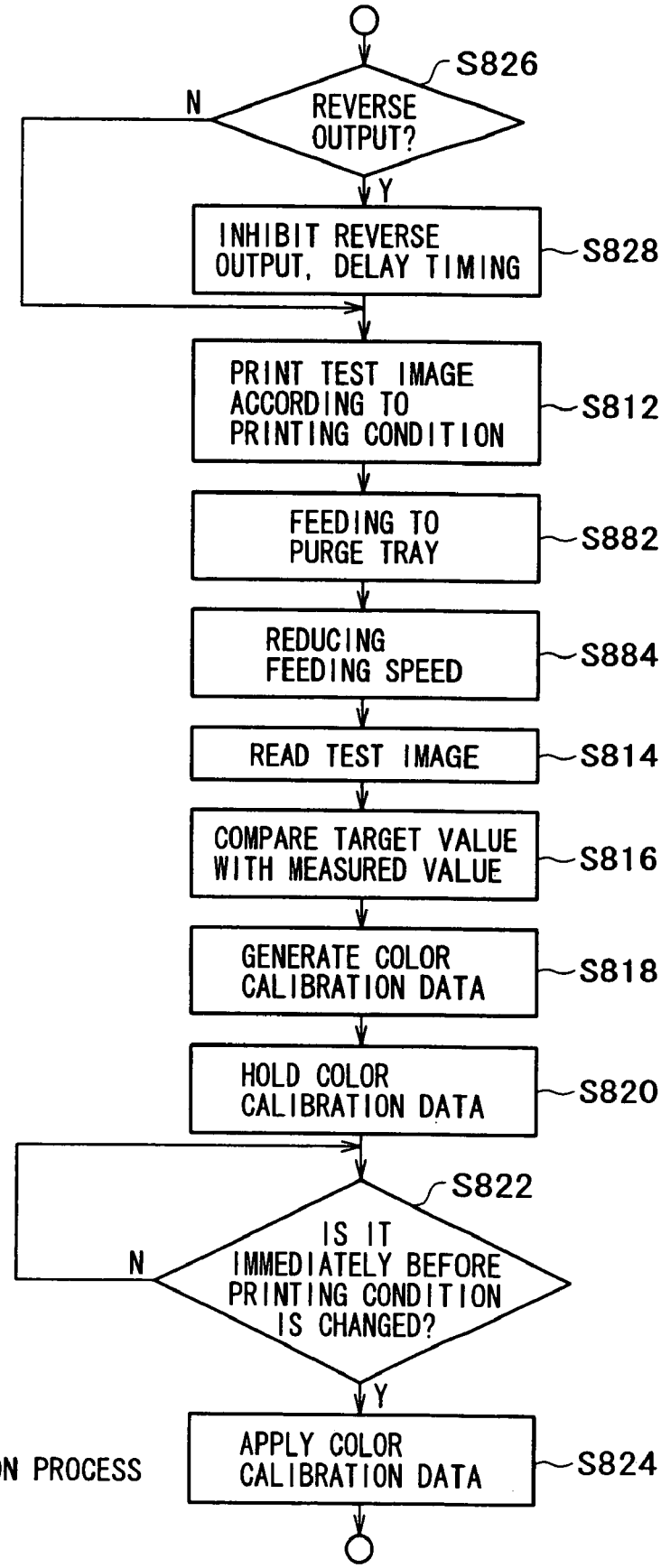
FIG. 16 is a flowchart for explaining a fourth color calibration process (S88) in the fourth embodiment.

FIG. 16 is a flowchart for explaining the fourth color calibration process (S88) in the fourth embodiment. It should be noted that the processes shown in this figure that are substantially the same as those shown in FIG. 10 are given the same numerals.

As shown in FIG. 16, the printer device 10 allows the calibration job to interrupt between the normal jobs to print the test image onto the recording sheet 42.

At a step 882 (S882), the sheet transfer controlling section 208 (FIG. 5) controls the sheet transfer device 18 for ing the recording sheet having the test image printed thereon to the purge tray 354 (FIG. 15) according to the calibration job.

When the sheet discharge path 310 transfers the recording sheet 42 having the test image printed thereon to the second branch position according to the control by the sheet transfer controlling section 208, the second changeover plate 310 introduces this recording sheet 42 to the purge path 330 according to the control by the sheet transfer controlling section 208.

At a step 884 (S884), the sheet transfer controlling section 208 controls the sheet transfer device 18 so as to temporarily stop the recording sheet 42 having the test image printed thereon in the vicinity of the colorimetric sensor 302 (FIG. 15).

When transferring the recording sheet 42 having the test image printed thereon to the vicinity of the colorimetric sensor 302 according to the control by the sheet transfer controlling section 208, the purge path 330 temporarily stops the transferring operation to temporarily stop this recording sheet 42, and then, discharges the sheet to the purge tray 352.

At S814, the printer device 10 causes the colorimetric sensor 302 to read the test image at the timing when the recording sheet 42 having the test image printed thereon is temporarily stopped.

As explained above, the printer device 10 in the fourth embodiment has the colorimetric sensor 302 disposed on the purge path 330, thereby being capable of decreasing the transferring speed of the recording sheet 42 at the timing when the test image is read, resulting in enhancing the reading precision of the test image.

Moreover, the recording sheet 42 having the test image printed thereon is always discharged onto the purge tray 354 in the printer device 10 in this embodiment, so that it becomes easy to separate the recording sheet 42 having the test image printed thereon from the recording sheet 42 having the requested image printed thereon.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-077627 filed on Mar. 18, 2004 including specification, claims, drawings and abstract is incorporated herein by reference in its entirety.

What is claimed is:

1. An image forming device comprising:

a toner image forming unit that successively forms onto a recording medium a requested toner image of an image requested by a user and a test toner image, where a controller controls the toner image forming unit to form the test toner image;

a sheet transfer unit that transfers the recording medium having the requested toner image formed thereon by the toner image forming unit, the sheet transfer unit includes a sheet transferring path from an image fixing position to a sheet exit tray and a sheet reversing path that is branched from a first branch position on the sheet transferring path for reversing the recording medium;

an image fixing unit that, at the image fixing position, fixes onto the recording medium at least one of a requested image and a test image based on a corresponding one of the requested toner image and the test toner image;

an image detecting unit, disposed downstream from the image fixing unit along the sheet transfer unit and disposed at the downstream side of the sheet exit tray along the sheet transferring path from the first branch position, that detects the test image formed on the recording medium, where the image detecting unit includes a colorimetric sensor disposed at a position facing a surface having an image formed thereon of a recording sheet that is output in a non-reverse manner;

a calibration unit that performs a color calibration process based upon the test image detected by the image detecting unit; and a sheet transfer controller that controls the sheet transfer unit so as to inhibit the reversing the recording medium having the test image formed thereon and to discharge the recording medium after a preceding recording medium if a reverse output is designated for a recording medium on which the requested image is to be formed.

2. The image forming device according to claim 1, wherein the sheet transfer controller controls the sheet transfer unit such that a space between the recording medium on which the test image is to be formed and the preceding recording medium is increased if the reverse output is designated for the recording medium on which the requested image is to be formed, compared to the case where the reverse output is not designated.

3. The image forming device according to claim 1, wherein if duplex printing is designated, the controller controls the toner image forming unit so as to form the test toner image on a recording medium that is reversed by the sheet reversing path.

4. The image forming device according to claim 1, wherein if duplex printing is designated, the controller controls the toner image forming unit so as not to form the test toner image on a first surface of the recording medium but to form the test toner image only on a second surface of the recording medium.

* * * * *